US011672300B2

(12) United States Patent
Fuerst

(10) Patent No.: US 11,672,300 B2
(45) Date of Patent: Jun. 13, 2023

(54) FOOTWEAR ARTICLE WITH WEAR GUARD

(71) Applicant: Fuerst Group, Inc., Menlo Park, CA (US)

(72) Inventor: Rory W. Fuerst, Atherton, CA (US)

(73) Assignee: Fuerst Group, Inc., Menlo Park, CA (US)

( * ) Notice: Subject to any disclaimer, the term of this patent is extended or adjusted under 35 U.S.C. 154(b) by 54 days.

(21) Appl. No.: 17/080,726

(22) Filed: Oct. 26, 2020

(65) Prior Publication Data

US 2021/0037909 A1 Feb. 11, 2021

Related U.S. Application Data

(63) Continuation-in-part of application No. 16/798,234, filed on Feb. 21, 2020, now Pat. No. 11,464,291.

(60) Provisional application No. 62/809,491, filed on Feb. 22, 2019.

(51) Int. Cl.
*A43B 3/00* (2022.01)

(52) U.S. Cl.
CPC ..... *A43B 3/00* (2013.01)

(58) Field of Classification Search
CPC ..... A43B 23/081; A43B 23/22; A43B 23/227; A43B 23/08; A43B 23/16; A43B 23/086; A43B 5/1683; A43B 3/02; A43B 7/32; A43C 13/14
See application file for complete search history.

(56) References Cited

U.S. PATENT DOCUMENTS 2,079,237 A * 5/1937 Allard ..... A43C 13/14 118/40
2,615,261 A * 10/1952 La Grotto ..... A43C 13/14 33/18.3
3,068,593 A * 12/1962 O'Donnell ..... A43C 13/14 D2/913
3,102,347 A * 9/1963 Griswold ..... A43C 13/14 D2/915
3,108,386 A * 10/1963 MacQuaid ..... A43C 13/14 D2/913
3,191,321 A * 6/1965 Brutting ..... A43B 5/02 36/77 R (Continued)

FOREIGN PATENT DOCUMENTS

BR PI1003644 A2 * 9/2010
EP 2071970 A1 * 6/2009 ..... A43B 7/32

(Continued)

OTHER PUBLICATIONS

ISA Korean Intellectual Property Office, International Search Report and Written Opinion Issued in Application No. PCT/US2020/019362, dated Jul. 17, 2020, WIPO, 10 pages.

*Primary Examiner* — Jillian K Pierorazio
(74) *Attorney, Agent, or Firm* — McCoy Russell LLP

(57) ABSTRACT

A footwear article is provided having an upper and a wear guard arranged across a vamp of the upper. In one embodiment, the wear guard is configured with a grid pattern of raised articulations extends entirely across a width of the vamp. In another embodiment, the footwear article also include a heel guard positioned above a heel region of the upper. In yet another embodiment, a tab may be coupled to the heel guard.

20 Claims, 10 Drawing Sheets

(56) References Cited

U.S. PATENT DOCUMENTS 4,194,310 A * 3/1980 Bowerman ..... A43B 5/06 36/32 R
4,366,629 A * 1/1983 Scherz ..... A43B 7/32 36/76 R
D282,599 S * 2/1986 Frey ..... D2/911
4,813,158 A * 3/1989 Brown ..... A43B 5/00 36/114
4,908,963 A * 3/1990 Krajcir ..... A43C 13/14 36/77 R
5,216,827 A * 6/1993 Cohen ..... A43B 5/025 36/114
5,319,869 A * 6/1994 McDonald ..... A43B 5/00 36/114
5,353,526 A * 10/1994 Foley ..... A43B 23/16 36/35 R
5,437,112 A * 8/1995 Johnston ..... B29D 35/146 36/133
5,457,898 A * 10/1995 Fortin ..... A43C 13/14 36/77 R
5,528,841 A * 6/1996 Pozzobon ..... A43B 19/00 36/3 A
5,878,511 A * 3/1999 Krajcir ..... A43B 23/082 36/77 R
D412,391 S * 8/1999 Covatch ..... D2/913
6,012,236 A * 1/2000 Pozzobon ..... A43B 19/00 36/3 R
D432,776 S * 10/2000 McDowell ..... D2/972
6,170,174 B1 * 1/2001 Gesso ..... A43B 23/087 36/77 R
D451,271 S * 12/2001 Gerber ..... D2/972
D452,070 S * 12/2001 Holmes ..... D2/972
6,389,715 B1 * 5/2002 Krajcir ..... A43B 23/082 36/77 R
6,631,569 B1 * 10/2003 Scharbius ..... A43B 7/32 36/72 R
D520,723 S * 5/2006 Hoeft ..... D2/972
7,650,703 B2 * 1/2010 Conolly ..... B63H 9/1007 36/8.1
7,941,946 B2 * 5/2011 Clancy ..... A43B 5/08 36/8.1
9,009,992 B2 * 4/2015 Baker ..... A43C 11/1493 36/133
9,038,288 B2 * 5/2015 Droege ..... A43B 5/025 36/133
9,179,732 B2 * 11/2015 Minami ..... A43B 23/028
9,737,114 B2 * 8/2017 Beye ..... A43B 1/0027
10,219,582 B2 * 3/2019 Spiller ..... A43B 13/187
D867,728 S * 11/2019 Whittington ..... D2/902
10,779,615 B2 * 9/2020 Minami ..... A43B 23/0245
11,266,205 B2 * 3/2022 Benchoff ..... A43B 23/087
2001/0022039 A1 * 9/2001 Krajcir ..... A43B 7/32 36/85
2002/0184794 A1 * 12/2002 Peterson ..... A43B 7/32 36/77 R
2003/0167658 A1 * 9/2003 Davis ..... A43C 13/14 36/128
2003/0196354 A1 * 10/2003 Chu ..... A43B 5/003 36/34 R
2004/0016150 A1 * 1/2004 Labonte ..... A43B 5/1666 36/115
2004/0261295 A1 * 12/2004 Meschter ..... B29D 35/146 36/55
2005/0016021 A1 * 1/2005 Marvin ..... A43B 13/203 36/35 B
2005/0241179 A1 * 11/2005 Chen ..... A43B 7/085 36/3 R
2006/0021256 A1 * 2/2006 Hess ..... A43C 13/14 36/72 R
2006/0042125 A1 * 3/2006 Chen ..... A43B 23/16 36/77 R
2006/0162190 A1 * 7/2006 Nishiwaki ..... A43B 5/10 36/97
2006/0174520 A1 * 8/2006 Wu ..... A43B 23/24 36/45
2008/0115387 A1 * 5/2008 Walworth ..... A43B 7/32 36/77 R
2011/0035963 A1 * 2/2011 Baker ..... A43B 13/40 36/114
2011/0099854 A1 * 5/2011 Foster ..... A43B 1/0009 36/3 A
2011/0302810 A1 * 12/2011 Borel ..... A43B 23/0255 36/114
2012/0180340 A1 * 7/2012 Crowley, II ..... A43B 1/0027 36/103
2012/0180341 A1 * 7/2012 Crowley, II ..... A43B 13/223 36/83
2013/0074374 A1 * 3/2013 Droege ..... A43B 7/24 36/133
2013/0091730 A1 * 4/2013 Spiller ..... B29D 35/0009 36/93
2013/0133229 A1 * 5/2013 Ludemann ..... B29D 35/0009 12/146 B
2014/0259760 A1 9/2014 Dojan et al.
2014/0259768 A1 * 9/2014 Spiller ..... A43B 23/088 36/87
2015/0150339 A1 * 6/2015 Van Hook ..... A43B 1/0018 36/84
2016/0166009 A1 6/2016 Hatfield et al.
2016/0331072 A1 * 11/2016 Gould ..... A43C 13/14
2017/0071291 A1 * 3/2017 Follet ..... A43B 23/028
2017/0273404 A1 * 9/2017 Doenges ..... A43B 23/0215
2018/0042337 A1 * 2/2018 Davis ..... A43B 3/02
2018/0116329 A1 * 5/2018 Champagne ..... A43C 5/00
2018/0263339 A1 * 9/2018 Neumann ..... A43B 23/0235
2018/0360156 A1 12/2018 Whiteman et al.
2019/0335858 A1 * 11/2019 Shin ..... A43B 23/081
2021/0321718 A1 * 10/2021 Chang ..... A43B 23/16

FOREIGN PATENT DOCUMENTS

EP 1874149 B1 7/2013
WO WO-0064292 A1 * 11/2000 ..... A43B 23/26

* cited by examiner

FOOTWEAR ARTICLE WITH WEAR GUARD

CROSS REFERENCE TO RELATED APPLICATION

The current application is a continuation-in-part of U.S. patent application Ser. No. 16/798,234, entitled "FOOTWEAR ARTICLE WITH WEAR GUARD," filed on Feb. 21, 2020, which claims priority to U.S. Provisional Patent Application No. 62/809,491, entitled "FOOTWEAR ARTICLE WITH WEAR GUARD," filed on Feb. 22, 2019, the contents of which is hereby incorporated by reference in its entirety for all purposes.

BACKGROUND/SUMMARY

Footwear articles may undergo substantial stress throughout their use, resulting in degradation of the footwear article over time. Depending on the particular movements of a user utilizing a footwear article, different regions of the footwear article may degrade at different rates. In the context of construction, repair work, and other related fields, for example, users may frequently perform knee-down work, lunging, squatting and other movements which cause frequent flexion at a vamp of a footwear article. Similarly, other activities such as hiking and various sports may also result in frequent flexion at a vamp of a footwear article. Such frequent flexion at a vamp of a footwear article is problematic, as it may lead to rapid degradation at the vamp, particularly where the vamp meets the quarters of the footwear article.

For example, substantial degradation, including formation of a hole, may occur approximately where the vamp and the quarters of the footwear article meet. Thus, degradation is concentrated at the vamp in comparison to a remainder of the footwear article.

Therefore, in view of the above, the inventors have developed a footwear article to at least partially address the above issues. In particular, the inventors have developed a footwear article comprising a flexible vamp wear guard positioned at a vamp of the footwear article. It is noted that the flexible vamp wear guard may also be referred to herein as a wear guard or vamp wear guard herein.

In at least one example, the flexible vamp wear guard may be formed as an overlay over an upper of the footwear article. However, in one or more examples, the flexible vamp wear guard may be integral with the upper of the footwear article. The flexible vamp wear guard may be formed to include bellows, including grooves and ribs, to ensure both structural support and flexibility. Furthermore, the flexible vamp guard may be integrated with a toe cap of the footwear article.

Via the footwear article flexible vamp wear guard as described-above, forces applied to the footwear articled via flexion at the vamp may be dispersed throughout the wear guard, preventing degradation of the footwear article. Furthermore, a flexibility of the flexible vamp guard may ensure that the footwear article is sufficiently flexible for user comfort and mobility.

BRIEF DESCRIPTION OF THE FIGURES

FIGS. 1-17 are drawn approximately to scale. However, other relative dimensions may be used if desired.

DETAILED DESCRIPTION

The following description relates to a footwear article including a wear guard configuration to prevent degradation of an upper of the footwear article while maintaining flexibility and mobility of the footwear article for user comfort.

As shown in FIGS. 1-5, 7, 11-13, and 17, the wear guard configuration of the footwear article may include a flexible vamp wear guard. The flexible vamp wear guard may be an overlay formed with bellows that include raised articulations which provide both force dispersion to prevent degradation of the footwear article while also allowing flexion at the vamp of the footwear article. The bellows may comprise various arrangements including ribs, grooves, as shown in FIGS. 1-4, or a grid pattern, as shown in FIGS. 5-15.

Figure 16:
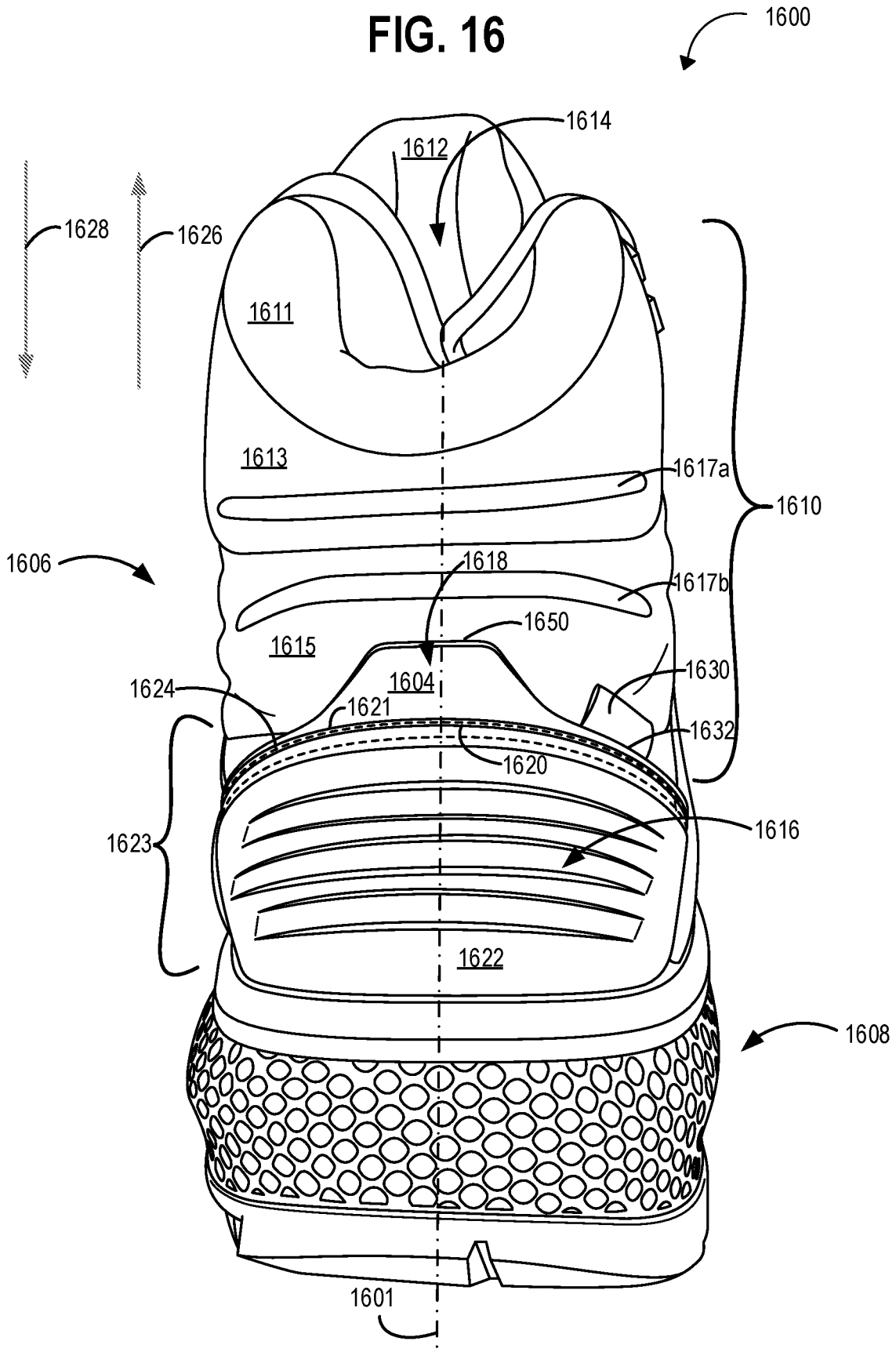
FIG. 16 shows a rear view of a fifth example footwear article that includes a tab, in accordance with one or more embodiments of the present disclosure.
Figure 17:
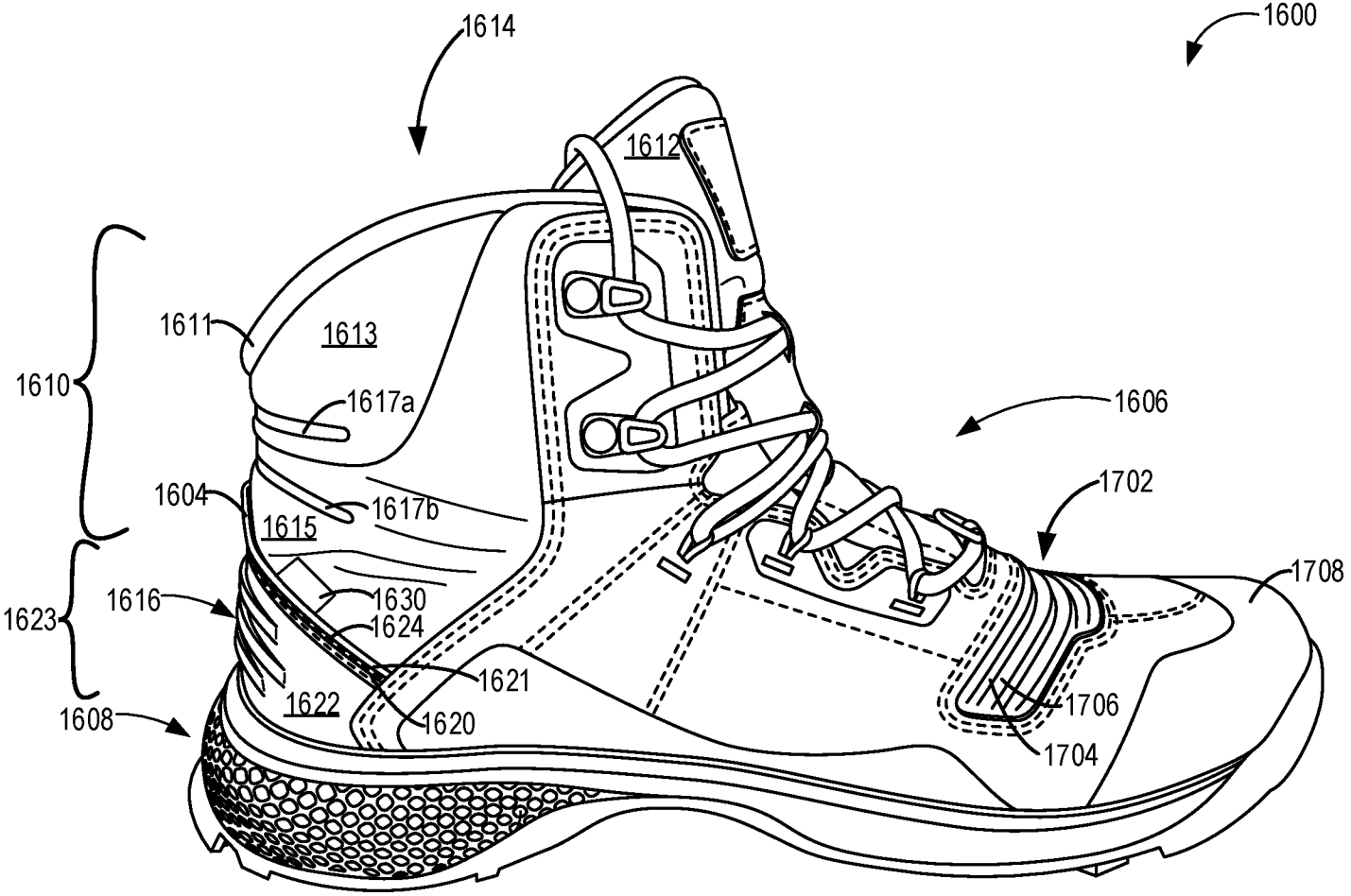
FIG. 17 shows a side view of the fifth example footwear article.

In one or more examples, such as shown at FIGS. 1, 3-6, 11, and 16-17, the bellows features may be integrated into the heel portion of the footwear article. In this way, flexion at a heel region of the upper may be enabled while avoiding degradation of the footwear article. In one or more representations, the flexible vamp wear guard and heel guard formed with bellows may be integrated with other wear guard components for improved force dispersion and strengthening of the wear guard. For example, the flexible vamp wear guard may be integrated with one or more of a toe cap, a heel cap, and perimeter wear guard components. In yet another example, the footwear article may be configured with a tab coupled to a rear side of the footwear article, as shown in FIGS. 16 and 17 to provide leverage to a user when gripped during donning/removal of the footwear article. The tab may be used with or without implementation of the wear guard configuration.

FIGS. 1-17 show the relative positioning of various components of a footwear article. If shown directly contacting each other, or directly coupled, then such components may be referred to as directly contacting or directly coupled, respectively, at least in one example. Similarly, components shown contiguous or adjacent to one another may be contiguous or adjacent to each other, respectively, at least in one example.

As an example, components lying in face-sharing contact with each other may be referred to as in face-sharing contact or physically contacting one another. As another example, elements positioned apart from each other with only a space there-between and no other components may be referred to as such, in at least one example.

As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Moreover, while various example footwear articles are used to illustrate various features, it is noted that the features across the various footwear articles described herein may be combined. For example, multiple bellows profiles and shapes may be included in the same footwear article. Thus, illustration of one footwear article is not exclusive of features included in other footwear articles illustrated herein. Rather, the features of the various footwear articles are interchangeable and combinable.

Figure 1:
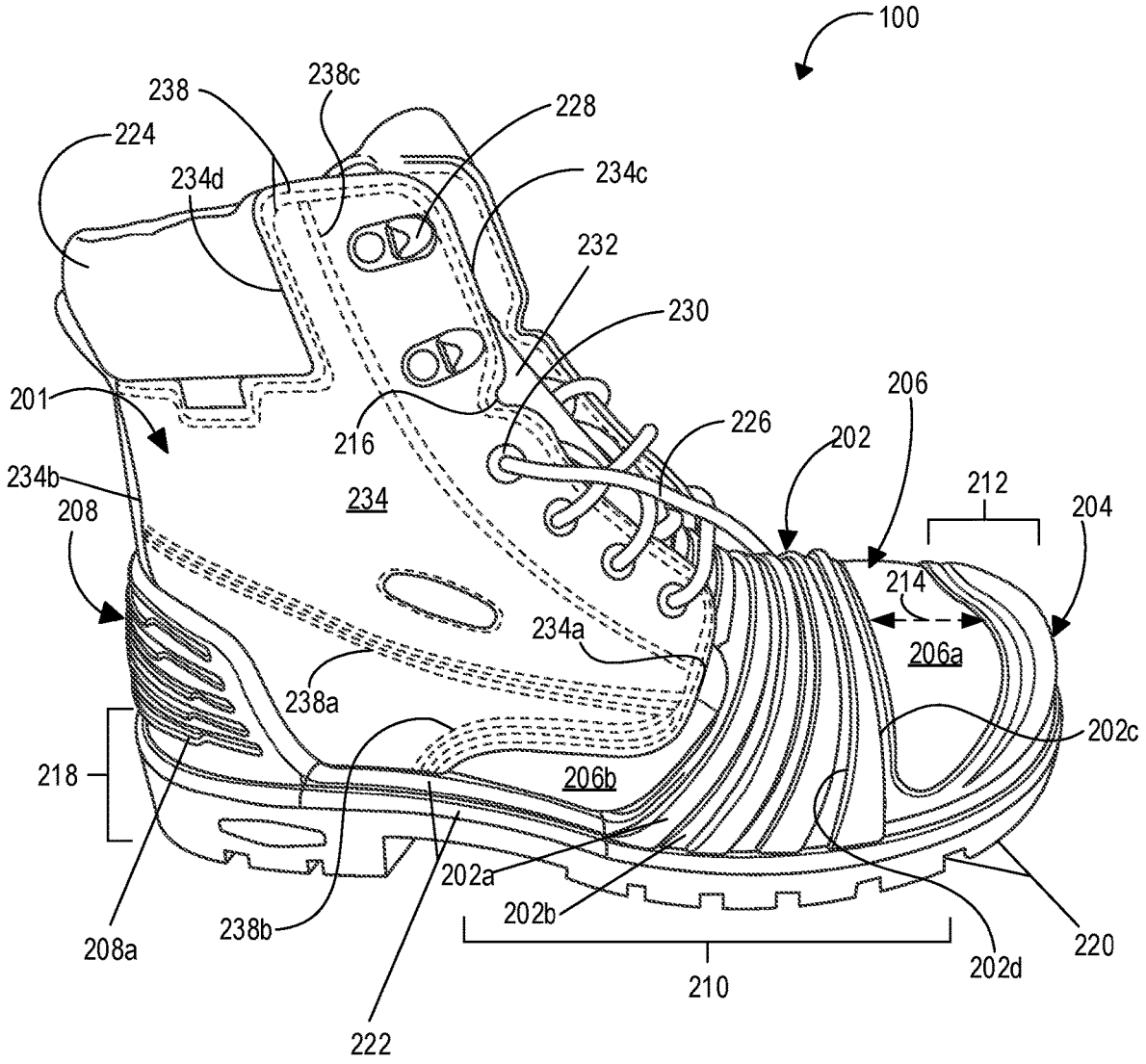
FIG. 1 shows a first side view of a first example footwear article, in accordance with one or more embodiments of the present disclosure.
Figure 2:
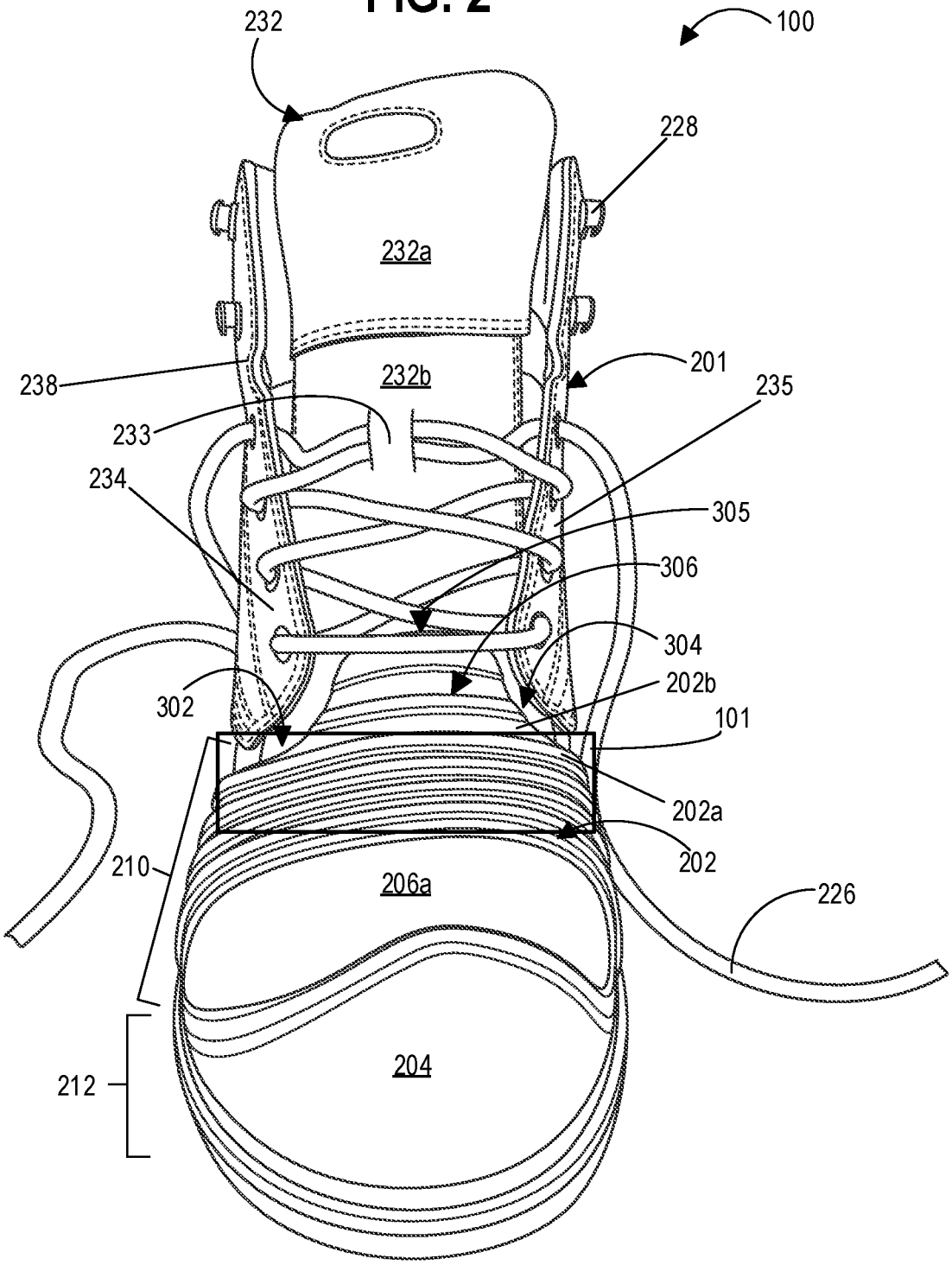
FIG. 2 shows a front view of the first example footwear article.
Figure 3:
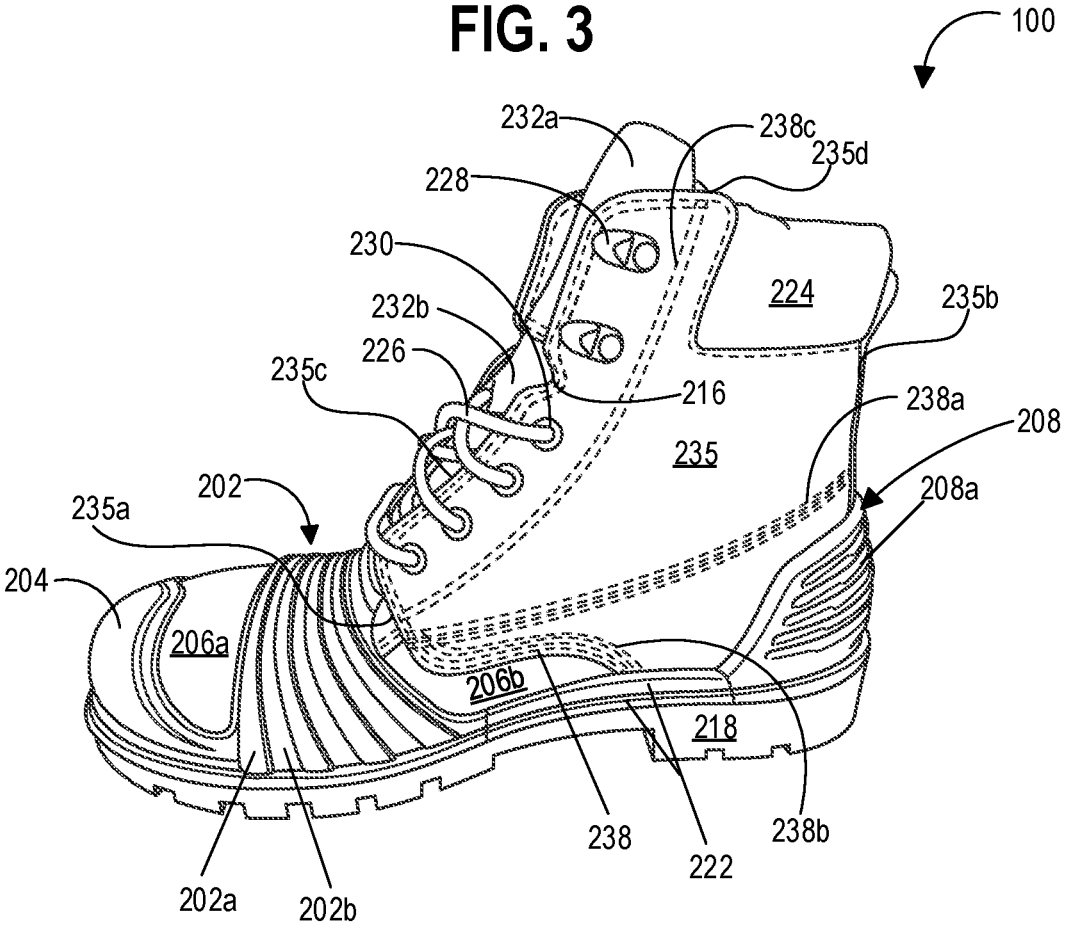
FIG. 3 shows a second side view of the first example footwear article.

FIG. 1 shows a first side view of a first example footwear article 100, in accordance with one or more embodiments of the present disclosure. The first example footwear article 100 is also shown in FIGS. 2 and 3 from a front view and a second side view, respectively, and FIGS. 1-3 will be described collectively.

In one or more examples, the first example footwear article 100 may be a work boot. However, it is noted that the footwear article 100 is not limited to work boots and that the features of footwear article 100 discussed herein extend to other types of footwear articles. Additionally, the features of other example footwear articles described herein, which may be illustratively shown as work boots, may also extend to other types of footwear articles. These different types of footwear articles may include casual footwear, sandals, various sporting footwear, and other types of boots.

The first example footwear article 100 may comprise a wear guard configuration that is a different material than an upper of the first example footwear article, the upper indicated generally by 201. Upper 201 may include vamp 206 (including toe cap interfacing portion 206*a* and quarter interfacing portion 206*b*), as well as side sections formed by first quarter 234, as shown in FIGS. 1 and 2, and second quarter 235, as shown in FIGS. 2 and 3. It is noted that the first quarter 234 and the second quarter 235 may also be referred to herein as a first quarter panel 234 and a second quarter panel 235, respectively. However, in other examples the upper of the footwear article may not include a structure with panels. For example, the upper 201 may instead be a single piece upper or an upper with an alternative paneling arrangement.

In at least one example, the wear guard configuration may comprise any one of natural rubber, vulcanized rubber, ethylene vinyl acetate (EVA), polyvinyl chloride (PVC), polyurethanes such as thermoplastic polyurethane (TPU), and other materials with similar properties. It is noted that any of the guards described herein which include the bellows formation or a grooves only formation may comprise one more of these materials. As to the upper, any of the uppers of the example footwear articles described herein may comprise any one or combination of a moldable material, leather, synthetic leather, knit textiles, nylon, and other materials with similar properties.

The wear guard configuration may be specifically shaped and positioned to protect the upper, while also being sufficiently flexible at vamp 210 to ensure user comfort. In particular, the wear guard configuration may be positioned and shaped so as to comfortably facilitate knee-down movements and other movements causing vamp flexion performed by a user wearing the first example footwear article while reducing material wear and degradation to the first example footwear article 100.

The wear guard configuration may include one or more components, including one or more of a flexible vamp wear guard 202, a toe cap 204, a heel cap 208, and a perimeter 222. The perimeter 222 may also be a bite line of an outsole 218 of the footwear article 100. It is noted that the flexible vamp wear guard 202 may be formed as an overlay in one or more examples. As such, flexible vamp wear guard 202 may also be referred to as a flexible vamp overlay or a wear guard herein. Furthermore, heel cap 208 may also be referred to as a heel guard herein.

The components of the wear guard configuration may be molded, in at least one example. In some examples, the wear guard configuration may a single molded piece. In other representations, however, components of the wear guard configuration may be molded separately and then joined together.

One or more components of the wear guard configuration may be directly molded to the upper 201 of the footwear article 100. Additionally or alternatively, one or more components of the wear guard configuration may be formed and then fixed to the upper 201 of the first example footwear article 100. For example, at least one component of the first example footwear article 100 may be molded and then coupled to the upper via an adhesive. It is appreciated that other attachment means for coupling one or more components of the wear guard to the upper may also be possible, such as stitching or ultrasonic welding.

The flexible vamp wear guard 202, which may be formed with bellows, is positioned at vamp 210 of the footwear article. The vamp 210 may be a region extending between toe 212 of the first example footwear article, and first quarter 234 and second quarter 235 of the first example footwear article 100. In particular, vamp 210 is along a lace line of the footwear article, on a toe side of the lace line. The vamp 210 includes a metatarsal phalangeal joint region 101 of the footwear article (see FIG. 2), which is a flexion region of the footwear article immediately adjacent the toe side of the lace line.

The flexible vamp wear guard 202 has a bellows structure, where the bellows structure of the flexible vamp wear guard 202 includes pleating. The pleating of the bellows structure may be formed by ribs 202*a* and grooves 202*b* of the bellows structure, described in further detail below. The pleating of the bellows structure may advantageously enable both expansion and flexion.

The bellows structure of the flexible vamp wear guard 202 may thus enable expansion and bending of the flexible vamp wear guard 202 at a flexion point of a user's foot. In particular, the bellows of the flexible vamp wear guard 202 may be positioned at a metatarsal phalangeal joint region, approximately at a region of a ball of a user's foot, during use. The metatarsal phalangeal joint is a flexion point during knee-down work, lunging, squatting, and other similar movements of a user. Thus, as the flexible vamp wear guard 202 may enable bending at the metatarsal phalangeal joint during use and is shaped to move with a user during use, degradation of the footwear article may be prevented while achieving user comfort.

Continuing with the footwear article, in at least one example, the first quarter 234 and the second quarter 235, as shown in FIG. 2, may include structures for retaining laces 226 of the footwear article. For example, the first quarter 234 and the second quarter 235 may include one or more eyelets 230 for receiving laces 226. Further, each of first quarter 234 and second quarter 235 may include a notch 216 to guide laces 226. Additionally or alternatively, first quarter 234 and second quarter 235 may include hooks 228 for receiving laces 226. It is further noted that in at least one example, the footwear article 100 may not comprise laces. Furthermore, the upper 201 of the footwear article 100 may comprise an alternative panel arrangement, straps, or a single piece structure.

First quarter 234 and the second quarter 235 form the sides of the first example footwear article and are a part of upper 201. As shown, the first quarter 234 and the second quarter 235 are panels which extend from the outsole 218 to a tongue 232 of the first example footwear article. Outsole 218 may form a bottom surface of the first example footwear article. The panels (e.g., the first and second quarters 234, 235) may comprise one or more pieces. Stitching 238 may be included to couple pieces of the panels together and/or to provide reinforcement throughout the first quarter 234 and the second quarter 235. Stitching 238 may further be included at the lacing structure, for example.

For example, first quarter 234 may comprise lateral support stitching 238*a*, where the lateral support stitching 238*a* includes stitching from a leading edge 234*a* of first quarter 234 to a heel edge 234*b* of the first quarter 234. The leading edge 234*a* of the first quarter panel is an edge of first quarter panel 234 closest to toe 212 of the first example footwear article. The heel edge 234*b* of the first quarter panel 234 is an edge of first quarter panel 234 closest to a heel of the first example footwear article. In at least one example, lateral support stitching 238*a* may comprises multiple rows of stitches. For example, lateral support stitching 238*a* may comprise three rows of stitches. In examples where the lateral support stitching 238*a* comprises multiple rows of stitches, these rows of stitches may be substantially parallel to one another.

Continuing, first quarter panel 234 may further comprise perimeter stitching 238*b*. Perimeter stitching 238*b* may be stitching that is positioned substantially at an edge of a panel and traces the edge of the panel. For first quarter 234, such perimeter stitching 238*b* may be positioned substantially at one or more edges of first quarter panel 234 and extend along these one or more edges. For example, first quarter 234 may comprise perimeter stitching 238*b* at any one or more of leading edge 234*a*, tongue edge 234*c*, and upper edge 234*d* of first quarter 234. Perimeter stitching 238*b* may include multiple rows of stitches in at least one example. Additionally, in one or more examples, a number of rows for perimeter stitching 238*b* may be varied along the edges of a same panel.

For example, leading edge 234*a* of first quarter 234 may comprise three rows of perimeter stitching 238*b* for approximately a first half of leading edge 234*a*, where the first half of leading edge 234*a* is closer to outsole 218 than a second half of leading edge 234*a*. Leading edge 234*a* of first quarter panel may further comprise two rows of perimeter stitching 238*b* for approximately a second half of leading edge 234*a*, where the second half of leading edge 234*a* is closer to tongue 232 than the first half of leading edge 234*a*. Thus, a same edge of the same panel may have varying rows of perimeter stitching 238*b*.

Such varying rows of perimeter stitching 238*b* at a same edge may be particularly advantageous to vary an amount of support along the same edge. For example, the first half of leading edge 234*a* comprising three rows of perimeter stitching 238*b* may have more support than the second half of leading edge 234*a*, where the second half comprises two rows of perimeter stitching 238*b*.

Additionally or alternatively, it is appreciated that a same number of rows for perimeter stitching 238*b* may be used for an entire edge of a panel. For example, two rows of perimeter stitching 238*b* may be used for a tongue edge 234*c* of first quarter 234. In one or more examples, a number of rows for perimeter stitching 238*b* may be varied from edge to edge for a same panel. For example, a first edge may have two rows of perimeter stitching 238*b* for the entire first edge, and a second edge may have three rows of perimeter stitching 238*b* for the entire second edge. Further still, in one or more representations, a same number of rows of perimeter stitching 238*b* may be used for all edges of a panel. It is noted that in examples where the upper may be a single piece upper, comprise a different paneling arrangement, or have straps, that different perimeter stitching or no perimeter stitching may be used.

Additionally or alternatively to the above stitching structures, first quarter 234 may include lace reinforcement stitching 238*c*. Lace reinforcement stitching 238 may be positioned such that one or more lace receiving structures (hooks 228, eyelets 230, notch 216) are positioned between the lace reinforcement stitching 238*c* and tongue edge 234*c*. Such lace reinforcement stitching 238 may extend a length of first quarter panel 234 from perimeter stitching 238*b* positioned at upper edge 234*d* of first quarter panel 234 to perimeter stitching 238*b* at leading edge 234*a* of the first quarter panel 234. The lace reinforcement stitching 238*c* may help to protect first quarter 234 from degradation due to pulling forces of laces 226. In other examples, however, the footwear article may not comprise laces and thus may not comprise lace reinforcement stitching.

In addition to the above, a tongue 232 may be positioned between the first quarter 234 and the second quarter 235, where the tongue 232 is at least partially overlapped by the first quarter 234 and the second quarter 235. The tongue 232 may include an upper portion 232*a* and a lower portion 232*b*, as described in relation to FIG. 2.

In at least one example, the first quarter 234 and the second quarter 235 may further both be coupled to an ankle support piece 224, where the ankle support piece 224 may be cushioned in one or more examples for user comfort. Ankle support piece 224 may further beneficially create a tighter fit to prevent entry of debris, for example.

In one or more examples, the flexible vamp wear guard 202 may be positioned on top of the upper. For example, a vamp portion 206 of the upper 201 may be partially covered by the flexible vamp wear guard 202. Vamp portion 206 may include a toe cap interfacing portion 206*a* and a quarter interfacing portion 206*b*.

The toe cap interfacing portion 206*a* may interface with toe cap 204 and flexible vamp wear guard 202, with the toe cap interfacing portion 206*a* positioned in a gap 214 formed between the toe cap 204 and flexible vamp wear guard 202. The quarter interfacing portion 206*b* may interface with flexible vamp wear guard 202 at the quarters (e.g., first quarter 234 and second quarter 235). However, in one or more examples where the footwear article comprises a single piece upper rather than a paneled structure, flexible vamp wear guard 202 may be positioned at the vamp to prevent degradation at the vamp. Alternatively, in another representation, the flexible vamp wear guard 202 may be integrated into the upper rather than on top of the upper 201. The flexible vamp wear guard 202 may be formed with bellows and thus include one or more ribs 202*a* and one or more grooves 202*b*, also referred to herein as transverse grooves. The one or more grooves 202*b* are recessed relative to the one or more ribs 202*a*.

The one or more ribs 202*a* and the one or more grooves 202*b* forming the bellows increase a flexibility at the vamp 210 while protecting the upper 201 from degradation. A material of the flexible vamp wear guard 202 may be thinner at the one or more grooves 202*b* of the flexible vamp wear guard 202 than the one or more ribs 202*a*, enabling the flexible vamp wear guard 202 to bend more easily at the one or more transverse grooves 202*b*. Meanwhile, the ribs 202*a*, which are thicker than the grooves 202*b* of the flexible vamp overlay 202, may help to prevent degradation of the upper 201 by distributing forces created by flexion at the vamp 210.

In at least one example, an end width of each of the ribs 202*a* may be wider at either end of each of the ribs 202*a* compared to a center of each of the ribs 202*a*. Put another way, each of the ribs 202*a* flares out at either end that is adjacent perimeter 222 and/or outsole 218. A center section of each of the ribs 202*a*, where the center section of each of the ribs 202*a* is a portion of the ribs 202*a* that is aligned with and positioned between a lacing structure and toe cap 204 of the footwear article, is thus narrower in width than the ends of the ribs 202*a*. Furthermore, the center section of the ribs 202*a* and the grooves 202*b* are substantially parallel to one another.

By having the width of each of the ribs 202*a* narrower at the center section of each of the ribs 202*a* compared to the ends of the ribs 202*a*, greater flexibility of the flexible vamp wear guard 202 may be achieved at the center of the vamp, which is a common flexion region of the footwear article. Thus improved user comfort and mobility may be achieved while still preventing degradation of the footwear article.

In addition to the ribs 202*a* varying in width across a length of the ribs 202*a*, each of the ribs 202*a* may have different curvatures. For example, as shown in FIG. 1, a leading edge 202*c* of the rib 202*a* closest to the toe cap 204 may be substantially perpendicular to perimeter 222 and/or outsole 218. It is noted that the leading edge 202*c* of each rib 202*a* refers to an edge of each rib 202*a* that is closest to the toe of the footwear article. The angle formed between a leading edge 202*c* of each of each rib 202*a* and the perimeter 222 and/or outsole 218 decreases the closer the rib 202*a* is to heel cap 208.

Furthermore, an angle formed between the trailing edge 202*d* of each rib 202*a* and the perimeter 222 and/or outsole 218 of the bellows increases the closer the rib 202*a* is to heel cap 208. It is noted that the trailing edge 202*d* of each rib 202*a* refers to an edge of each rib 202*a* that is closest to the heel of the footwear article.

Such shaping of the ribs 202*a* with the above curvatures may help to ensure bending throughout the flexible vamp overlay 202, so that the flexible vamp wear guard 202 bends with a user as the user moves.

In addition to the flexible vamp overlay 202, the wear guard configuration further includes toe cap 204. Toe cap 204 is positioned at a toe of the first example footwear article. In at least one example, toe cap 204 may be positioned on top of overlay 202 of the footwear article. However, in other examples, toe cap 204 may be integral with upper 201 rather than positioned on top of upper 201.

Toe cap 204 is advantageously shaped so as to extend further into the footwear article over a big toe position for a user. Such shaping may beneficially provide additional protection at the big toe position. Toe cap 204 may further beneficially prevent degradation of the footwear article due to scuffing, moisture and debris at the toe 212.

Moreover, toe cap 204 may connect to the flexible vamp guard 202, where the vamp guard is also referred to as a wear guard herein. Thus, the toe cap 204 and the flexible vamp wear guard 202 may form an integrated structure. That is, the toe cap 204 and the flexible vamp wear guard 202 be a single, unitary structure. Such integration of the toe cap 204 with the flexible vamp wear guard 202 may achieve advantages as to improved support and degradation prevention of the upper 201. While the flexible vamp wear guard 202 may be formed with bellows, however, it is noted that toe cap 204 may not be formed without bellows.

The first example footwear article further includes a gap 214 (as shown in FIG. 1) between the toe cap 204 and the flexible vamp guard 202. Specifically, gap 214 may be defined by the toe cap 204 and the flexible vamp overlay 202, with an entire perimeter of gap 214 formed by the toe cap 204 and the flexible vamp overlay 202.

Toe cap 204 transitions to the flexible vamp wear guard 202 at a same location where the toe 212 of the footwear article is indicated to transition to the vamp 210 of the footwear article. Thus, gap 214 may be completely surrounded by the toe cap 204 and the flexible vamp overlay 202. A vamp portion 206 of upper 201 may be positioned within gap 214 and exposed via gap 214. In particular, toe cap interfacing portion 206*a* of the upper 201 may be positioned within gap 214 and exposed via gap 214. Thus, due to gap 214, vamp portion 206 of upper 201 within gap 214 forms part of an external surface of the footwear article. Specifically, toe interfacing portion 206*a* is positioned within gap 214 and forms part of an external surface of the footwear article.

As degradation is typically concentrated at a region of the vamp adjacent quarters of a footwear article, the inclusion of gap 214 may result in a wear guard configuration which strategically protects the upper 201 at locations most susceptible to damage. This strategic approach to protecting the upper may advantageously provide protection against degradation, while avoiding unnecessary overuse of materials.

Moreover, the inclusion of a gap 214 may further be beneficial for reducing an overall weight of the footwear article compared to fully covering the vamp and the toe. Such reduced weight may contribute to overall improved user comfort.

In addition to the toe cap 204, further toe protection may be provided via a toe reinforcement structure. For example, the footwear article may include a toe reinforcement structure underneath the upper 201 at the toe of the footwear article. The toe reinforcement structure may comprise steel, or a composite such as carbon fiber, a dense plastic, or Kevlar, for example. However, in other examples the footwear article may not comprise a toe reinforcement structure.

In one or more examples, the wear guard configuration may further comprise a heel cap 208 positioned at a heel of the first example footwear article. Heel cap 208 may comprise ribs 208*a* for increased structural support. In at least one example, however, heel cap 208 may be more rigid than the flexible vamp wear guard 202. For example, a thickness of heel cap 208 may be greater than a thickness of the flexible vamp wear guard. Thus, although heel cap 208 includes ribs 208*a*, similar to the flexible vamp wear guard 202, it is noted that heel cap 208 does not have the same structuring of the flexible vamp wear guard 202 and heel cap 208 may achieve less flexibility than the flexible vamp wear guard 202.

In at least one representation, heel cap 208 may be positioned on top of upper 201 of the footwear article. However, it is appreciated that heel cap 208 may alternatively be integrated into upper 201.

Heel cap 208 may be connected to the flexible vamp wear guard 202 via perimeter 222 of the wear guard configuration. For example, the heel cap 208 may be connected to the flexible vamp wear guard 202 via perimeter 222 of the wear guard configuration. Thus, the heel cap 208, flexible vamp overlay 202, and the toe cap 204 may be an integrated structure.

By connecting the heel cap 208, the flexible vamp overlay 202, and the toe cap 204 via perimeter 222, the wear guard configuration may be able to effectively disperse forces to prevent degradation of the upper 201. Moreover, by forming the heel cap 208, the flexible vamp overlay 202, and the toe cap 204 as an integrated structure, improved structural stability of the wear guard configuration itself may be achieved.

In at least one example, the perimeter 222 of the wear guard configuration may be a component that is positioned along an entire perimeter of the footwear article or substantially the entire perimeter of the footwear article. Perimeter 222 of the wear guard configuration may be positioned between the outsole 218 and the upper 201.

In at least one representation, the perimeter 222 of the wear guard configuration may be positioned over a portion of the outsole 218 and a portion of the upper 201. The outsole 218 may include a tread 220, in at least one example. Perimeter 222 may beneficially prevent degradation of the footwear article where the upper 201 and the outsole meet.

Further, in addition to connecting other components of the wear guard configuration to improve force dispersion, and thus prevent degradation of the upper 201, the perimeter 222 of the wear guard configuration may further beneficially improve a coupling of the upper 201 to the outsole 218.

Turning now to FIG. 2, a front view of the first example footwear article 100 is shown. As shown at FIG. 2, tongue 232 includes an upper portion 232*a* and a lower portion 232*b*. The upper portion 232*a* of the tongue 232 may be padded for user comfort and gripping, in at least one example.

The lower portion 232*b* of tongue 232 may include a lace guide 233 for positioning laces 226. Further, the flexible vamp wear guard 202 may include an extension 306 that extends onto lower portion 232*b* of tongue 232. Extension 306 may advantageously help to further disperse forces and prevent degradation of the upper 201. In at least one example, the extension 306 may be rounded to ensure user comfort and to prevent degradation of the upper.

The extension 306 may be positioned between the first quarter 234 and the second quarter 235. In at least one example, extension 306 may be positioned such that extension 306 does not contact the first quarter 234 and the second quarter 235. Extension 306 may further be positioned such that at least a portion of extension 306 is positioned underneath laces 226.

By including extension 306 on lower portion 232*b* of tongue 232 and at least partially underneath laces 226, extension 306 may not only serve to disperse forces to prevent degradation of the upper 201, but also may advantageously provide structural rigidity to prevent wrinkling and degradation of tongue 232. Extension 306 may be formed adjacent the metatarsal phalangeal joint region 101 of the footwear article.

Extension 306 may also be formed with bellows. Thus, extension 306 may also include ribs 202*a* and grooves 202*b*, similar to flexible vamp overlay 202. However, the ribs 202*a* and the grooves 202*b* of the extension 306 bellows may be spaced further apart than a spacing of the ribs 202*a* and the grooves 202*b* along the vamp 210 of the footwear article. That is, a distance between the ribs 202*a* and the grooves 202*b* of the flexible vamp wear guard 202 bellows may be less than a distance between the ribs 202*a* and the grooves 202*b* of the extension 306 bellows.

The further spacing between the ribs 202*a* and the grooves 202*b* at the extension 306 may allow extension 306 to bend in a manner that mimics a user knee-down, lunging, squatting, or other similar position. That is, when a user is in a knee-down position, for example, less flexion is needed at the lower portion 232*b* of tongue 232 than at the vamp 210. Thus, the ribs 202*a* and the grooves 202*b* of the extension 306 bellows are spaced further apart at the lower portion 232*b* of tongue 232 than at the vamp 210 to accommodate such user movement while still providing as much support as possible.

Turning back now to FIG. 1, it is noted that the inclusion of a flexible vamp wear guard 202 including any one or combination of the profiles discussed herein achieves several advantages. For example, by including such a flexible vamp wear guard that covers at least the metatarsal phalangeal joint region (e.g., the metatarsal phalangeal joint region 101 at FIG. 2) of vamp 210, degradation of the upper 201 at the vamp 210 may be avoided, as forces may be dispersed throughout the wear guard. Moreover, the further inclusion of an extension such as extension 306 from the flexible vamp wear guard 202 onto the lower portion of the tongue 232*b* may help to even further prevent degradation.

Continuing with FIG. 2, as further shown, the flexible vamp wear guard 202 may include a first curve 302 along the first quarter 234 and a second curve 304 along the second quarter 235.

The first curve 302 and the second curve 304 may advantageously accommodate the first quarter 234 and the second quarter 235, respectively, to prevent degradation of the first quarter 234 and the second quarter 235 due to friction.

That is, rubbing of the first quarter 234 and the second quarter 235 against the flexible vamp wear guard 202 may lead to degradation of upper 201 at the first quarter 234 and the second quarter 235. Thus, shaping the flexible vamp wear guard 202 to include the first curve 302 and the second curve 304 may help to avoid such degradation, as contact may be minimized or prevented.

As further shown in FIG. 2, the flexible vamp wear guard 202 is substantially symmetrical. Thus, second curve 304 of the flexible vamp wear guard 202 substantially mirrors a shape of first curve 302 of the flexible vamp guard 202.

The first curve 302 of the flexible vamp wear guard 202 continuously curves and transitions to extension 306, including peak 305 of extension 306. Similarly, second curve 304 of the flexible vamp wear guard 202 also continuously curves and transitions to extension 306, including peak 305 of extension 306. The continuous curved shape of the transition between the flexible vamp wear guard 202 and extension 306 at first curve 302 and second curve 304 may advantageously increase user comfort while also avoiding degradation to the upper.

Turning to FIG. 3, FIG. 3 shows a second side view of the first example footwear article 100. As may be seen in FIG. 3, a shaping of ribs 202*a* and grooves 202*b* of the flexible vamp wear guard 202 are substantially a same shape and sizing on the second side of the first example footwear article as on the first side. Furthermore, second quarter 235 may be more clearly viewed in FIG. 3. It is noted that leading edge 235*a*, heel edge 235*b*, tongue edge 235*c*, and upper edge 235*d* of second quarter 235 correspond to leading edge 234*a*, heel edge 234*b*, tongue edge 234*c*, and upper edge 234*d* of second quarter 234. Details as to the edges, stitching, and the lacing structures of first quarter 234 similarly apply to second quarter 235 and are not further discussed herein.

Referring to FIGS. 1-3, it is clearly seen that wear guard 202 extends from an outsole 218 of the footwear article at a first side of the footwear article to an outsole 218 of the footwear article at a second, opposite side of the footwear article. In particular, the wear guard 202 extends from an instep side of the outsole 218 to an outstep side of the outsole, the wear guard 202 extending across a vamp 210 of the footwear article and the metatarsal phalangeal joint region 101 of the footwear article. The wear guard 202 may be coupled between outsole 218 and the upper of the footwear article, in at least one example. However, in other examples, the wear guard 202 may meet the outsole 218 at a top edge of the outsole 218 without being positioned underneath the outsole 218. In this way, degradation of the footwear article may be avoided while maintaining sufficient flexibility.

Figure 4:
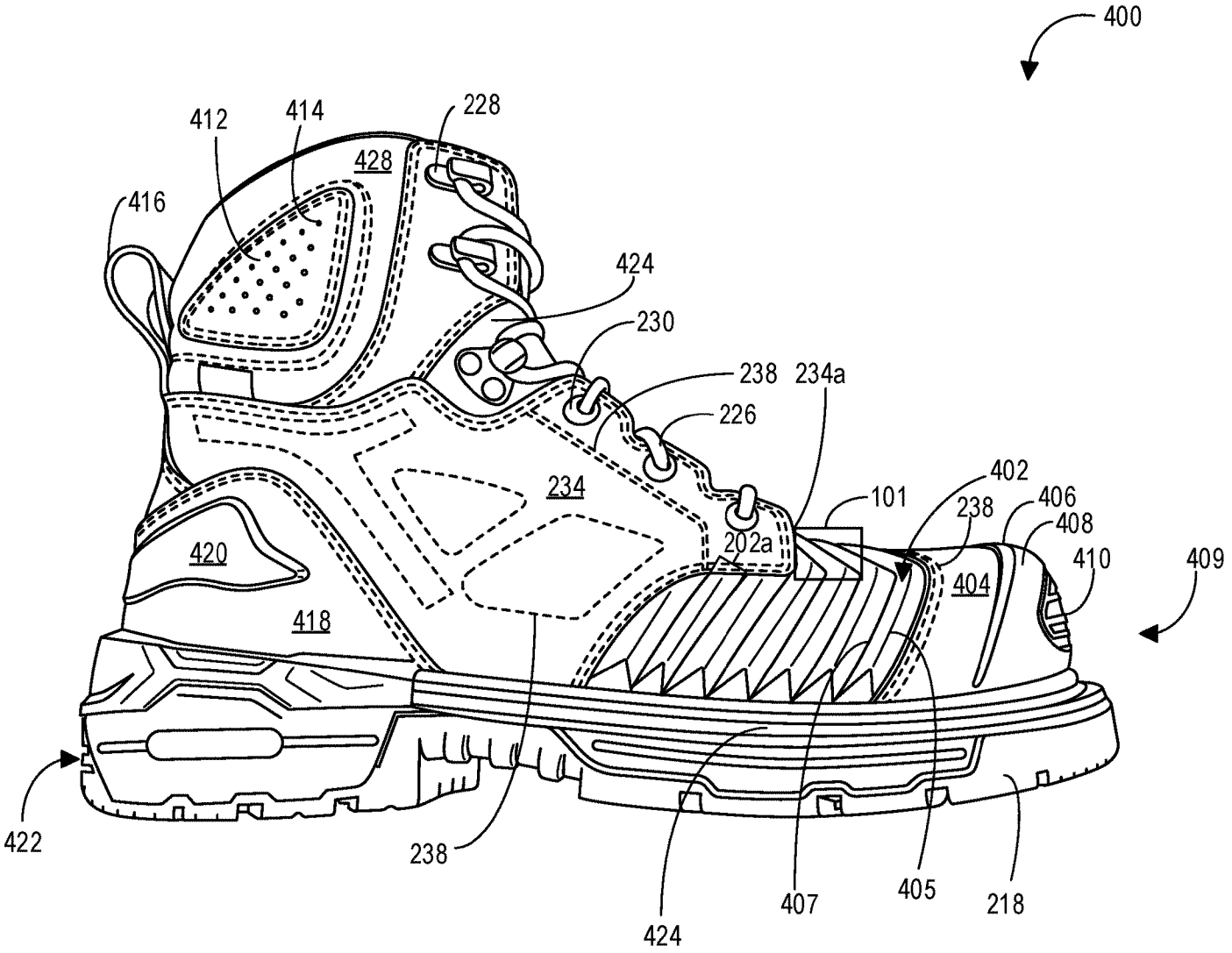
FIG. 4 shows a side view of a second example footwear article.

Turning now to FIG. 4, FIG. 4 shows a side view of a second example footwear article 400. As may be seen in FIG. 4, ridgelines 405 and valleys 407 formed by the bellows of wear guard 402 have a bend approximately aligned with the lace guides in the quarter panels. The ridgelines 405 formed by the bellows thus transition from curving towards a tongue of the footwear article to curving around the quarter panels, to extending in a direction that is approximately a 25 degree to a 50 degree angle relative to a direction in which a midsole 424 extends. Though the opposite side is not shown, it is noted that the wear guard 402 extends from an outstep side of the footwear article to an instep side of the footwear article, extending across the metatarsal phalangeal joint region 101. In particular, wear guard 402 meets the midsole 424 at either side of the footwear article. In at least one example, the wear guard 402 may be partially positioned between the midsole 424 and the upper of the footwear article, such that the wear guard is partially underneath the midsole 424.

In the example footwear article shown at FIG. 4, a toe guard 409 comprises a first toe guard panel 404, a second toe guard panel 408, and a ridge 406 positioned between the first toe guard panel 404 and the second toe guard panel 408. In at least one example, the first toe guard panel 404 may comprise a first material, where the first material is a flexible material, such as leather, TPU, etc. The second toe guard panel 408 may comprise a second material, where the second material is less flexible than the first material. The second material may be a rubber or a plastic material in at least on example. Further, the second material may be a textured material, such that the first material is smooth in comparison to the second material in at least one example. In addition to including a ridge 406, the second toe guard panel 408 may further include grips 410. Such a configuration may help to prevent degradation of a toe of the footwear article while still maintaining flexibility.

In addition to the toe guard 409, the footwear article 400 at FIG. 4 further includes the quarter panel 234 that may comprise the first material. In at least one example, the quarter panel 234 may further include one or more features formed of stitching 238. Such features may be reinforcing features, in at least one example. At an ankle of the footwear article in FIG. 4, there may be a padded feature 412 in at least one example. The padded feature 412 may include one or more openings 414. Such openings may beneficially allow air to be pushed out of the padded feature 412 upon compression, in at least one example. In addition to the padded feature 412, the footwear article 400 at FIG. 4 further includes a heel tab 416, which may be useful to pull the shoe on, in at least one example. Moreover, regions of the upper of the footwear article 400 may comprise a third material, such as at regions 424 and 428. It is noted that regions 424 and 428 may be a base of the upper, in at least one example, and the quarter panel 234, the wear guard 402, and the toe guard features may all be overlays on top of the base.

The footwear article 400 at FIG. 4 further includes a molded lateral heel panel 418, including a molded guard 420. The molded guard 420 may be positioned at approximately an ankle joint of a user when the footwear article is worn. The molded guard 420 may further wrap around a heel of the footwear article. The molded guard 420 may provide additional lateral rigidity, in at least one example.

As can further be seen, the footwear article 400 at FIG. 4 includes the outsole 218, with various textured features. Such textured features include ribs 422 at a heel of the footwear article. It is noted that the textured features of the outsole 218, such as ribs 422, may advantageously improve grip of the footwear article.

Turning now to FIGS. 5-10, another embodiment of a footwear article 500 is depicted. It is noted that one or more of the bellows configurations described at FIGS. 1-4, 11, and 16-17 may be used in combination with the bellows configuration at FIGS. 5-10. Or, in at least one example, the bellows configurations as described at FIGS. 5-10 may be used as an alternative to the examples described at FIGS. 1-4, 11, and 16-17 or one or more of the bellows configurations as described at FIGS. 1-4, 11, and 16-17 may be used without combination of the bellows configurations as discussed at FIGS. 5-10. It is noted that combining the bellows configurations may include combining one or more of the profiles, positioning, and curvatures of the bellows features.

Figure 5:
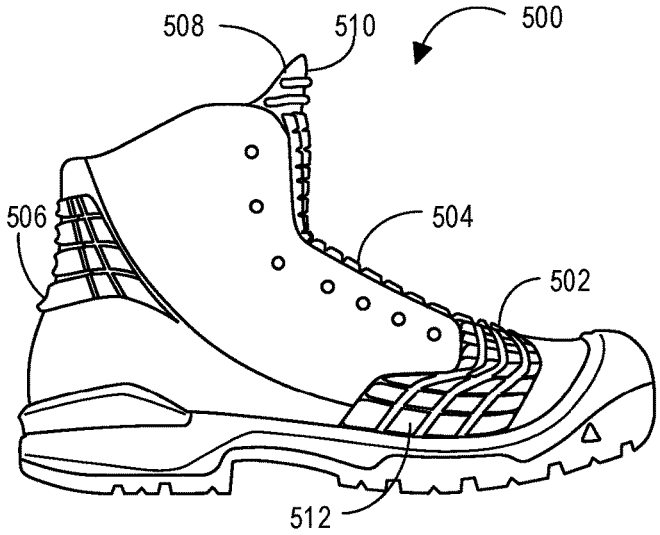
FIG. 5 shows a side view of a third example footwear article, in accordance with one or more embodiments of the present disclosure.

Turning now to FIG. 5, FIG. 5 shows a side view of a fourth example footwear article 500, according to one or more examples of the present disclosure. As may be seen in FIG. 5, the footwear article 500 has a wear guard configuration including a wear guard 502 that may be positioned at the vamp, including the metatarsal phalangeal joint region 101. The footwear article 500 may further include one or more of a flexion wear guard 504 positioned on the tongue of the footwear article 500 and a heel wear guard 506 positioned at a heel region of the footwear article 500. Looking briefly to FIG. 6, which shows a rear view of the fourth example footwear article 500, the heel guard 506 comprises a plurality of bellows features in a grid formation, where the grid comprises a plurality of raised articulations shaped as quadrilaterals, hereafter, quadrilaterals 512 which extend across a heel of the footwear article 500. The grid includes a curvature towards the outsole 218 of the footwear article 500. In at least one example, it is noted that heel guard 506 may further include one or more rib formations which follow a similar curvature as the grid. A rounded extension to accommodate these additional rib formations at a top of the heel guard 506 may also be included. Moreover, it is noted that a shaping of the heel guard 506 may be varied in at least one example. For example, the heel guard 506 may be substantially triangular in shape with rounded flanges at each point of the triangle. One or more of the rounded flanges may be tapered in at least one example. It is noted that the edges of the heel guard 506 may be stitched to the footwear article in at least one example. For example, a top end of the heel guard 506 may include a flange which is stitched to a top of the footwear article, including on top of the upper and foam padding of the footwear article. A bottom end of the heel guard 506 may include a flange (such as a tapered flange) which is stitched between the upper and an internal counter of the footwear article. A lining may be positioned directly behind the grid of the heel guard 506, in at least one example. In at least one example, a portion or all edges of the heel guard 506 may be tapered, to form a tapered flange which borders the entire heel guard 506.

Figure 8:
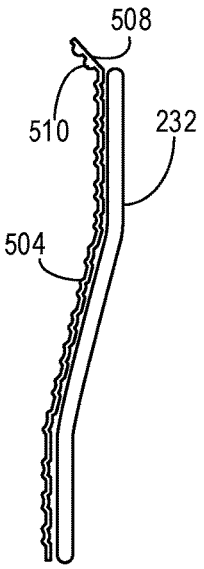
FIG. 8 shows a profile view of the bellows configuration of the third example footwear article.

As further illustrated at FIG. 5, the footwear article may further include a pull tab 508 which extends at a top of a tongue of the footwear article. Looking briefly to FIG. 8, which shows a profile view of the bellows configuration of the fourth example footwear article 500, it can be seen that the pull tab 508 is an extension of the flexion wear guard 504. In particular, as seen in FIG. 8, the flexion wear guard 504 is positioned on top of and coupled to tongue 232. Pull tab 508 extends from the flexion wear guard 504 to above tongue 232, such that the pull tab 508 is not coupled directly to the tongue 232. Rather, pull tab 508 is coupled indirectly to tongue 232 via flexion wear guard 504. The pull tab 508 further includes one or more ridges 510 which can make it easier to grip pull tab 508. The pull tab 508 feature may advantageously enable a user to maneuver tongue 232. In at least one example, pull tab 508 may comprise TPU and/or rubber material. Furthermore, the ridges 510 of pull tab 508 may include tapered edges in at least one example.

Figure 7:
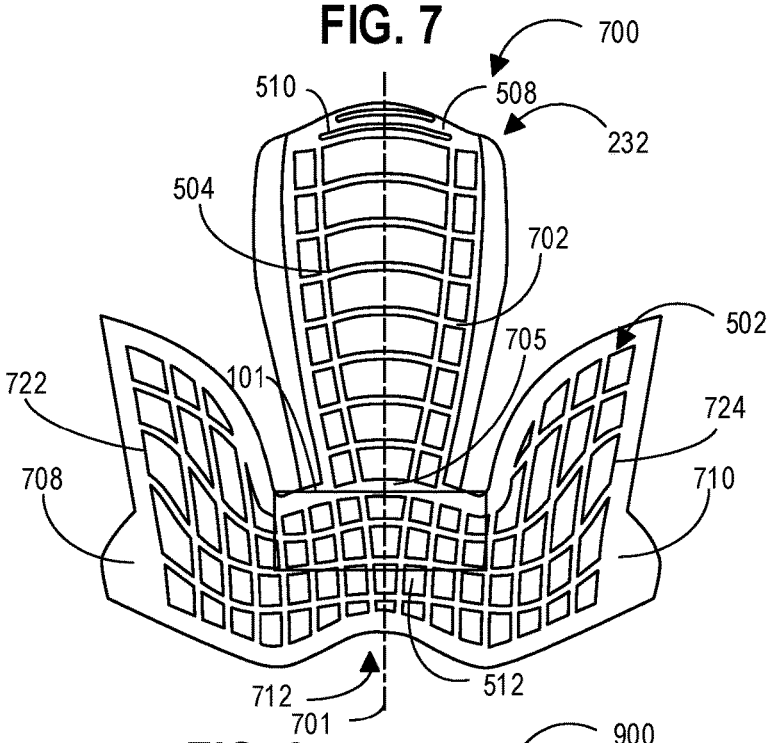
FIG. 7 shows a bellows configuration of the third example footwear article.

Looking now to FIG. 7, FIG. 7 shows a bellows configuration 700 of the seventh example footwear article 500. As may be seen in FIG. 7, the bellows configuration is a grid configuration comprising a plurality of quadrilaterals 512. The bellows configuration has wings 708 and 710, medial panel 712, and tongue 232 of the bellows configuration may be formed as a single piece, in at least one example, and the heel guard 506 may be formed as a separate piece. The quadrilaterals 512 of the grid may vary in size. Each quadrilateral 512 of the grid may be molded to include a similar top surface shaping, as discussed in further detail below. Further, the grid may be symmetrical about a medial axis 701 of the bellows configuration 700. In at least one example, a height of the quadrilaterals 512 may be varied within the grid. For example, the quadrilaterals 512 positioned along the medial panel 712 may be shorter than the quadrilaterals 512 positioned on wings 708, 710. In at least one example, the junction where the wings 708, 710 meets the medial panel 712 may have a height change, where the medial panel 712 quadrilaterals 512 are shorter than the wing 708, 710 quadrilaterals 512 at the junction. Outer edges 722, 724 of the grid formed by the quadrilaterals 512 may be curved to match a shape of a top line of a midsole of the footwear article 500. Or, in examples where there may not be a midsole, the outer edges 722, 724 of the grid formed by the quadrilaterals 512 may be curved to match a top line of the outsole. In this way, the outer edges 722, 724 may be positioned adjacent the midsole or outsole in an aligned manner without gaps.

In at least one example, the tongue 232 portion of the bellows grid may be attached to the tongue of a footwear article via a material which wraps around from a back of the tongue to on top of the tongue 232 portion of the bellows grid. This material may be stitched on top of the tongue 232 portion at an edge of the bellows grid. The material is not stitched on top of the quadrilaterals 512. Foam may be positioned between the material and the bellows grid for padding, in at least one example.

The inclusion of a grid bellows configuration 700 as shown may advantageously improve flexion in every position. For example, whereas other bellows configurations discussed herein may be suited for flexion across the forefoot from the medial to lateral sides, the grid configuration may enable flexion with a user in any position. It is further noted that the quadrilaterals 512 of the grid are separated by valleys 702 (also referred to herein as voids). The inclusion of such valleys 702 enables flexion in combination with the formation of each of the quadrilaterals 512 to flex in both flexed and extended positions. It is noted that there is specifically a valley (which may also be referred to herein as a void) at throat 705 between the tongue 232 and the medial panel 712 in order to ensure that the wear guard flexes at the base of the throat 705.

Figure 9:
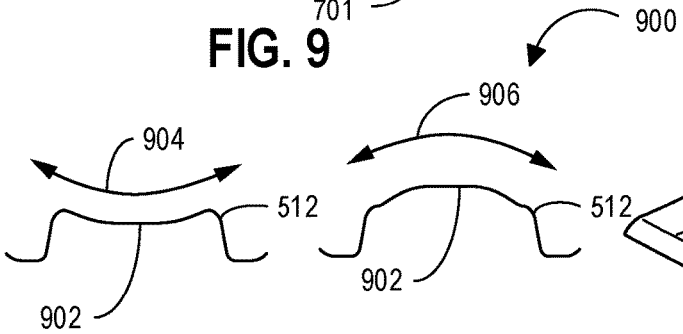
FIG. 9 shows a schematic representation of bellows features of the third example footwear article.
Figure 10:
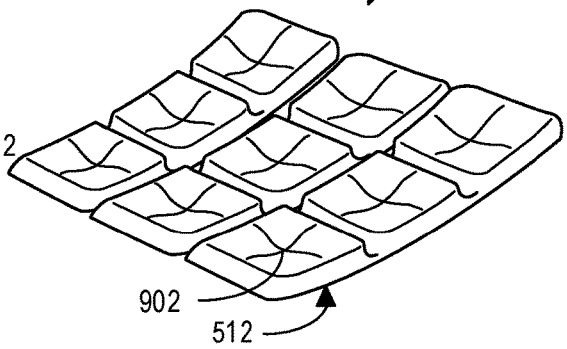
FIG. 10 shows a schematic representation of the bellows features of the third example footwear article.

Looking briefly to FIG. 9, FIG. 9 shows a schematic representation 900 of the bellows features of the fourth example footwear article 500, in accordance with one or more embodiments of the present disclosure. As may be seen in FIG. 9, a top surface 902 of the quadrilaterals 512 is formed to follow a direction of manipulation. For example, the top surface 902 of the quadrilateral 512 is formed such that the top surface 902 creates a concave formation when undergoing flexion, as indicated by arrow 904. That is, the top surface 902 includes a crater when manipulated to be flexed, as indicated by arrow 904. In contrast, the top surface 902 of the quadrilaterals 512 is formed such that the top surface is convex when undergoing extension, as indicated by arrow 906. That is, the top surface 902 bulges outward responsive to extension, as indicated by arrow 906. As may be seen at FIG. 10, which shows a schematic representation 1000 of the bellows features of the fourth example footwear article 500, the top surfaces 902 of the quadrilaterals 512 are concave as their home position. That is, when not undergoing flexion or extension, the top surfaces 902 of the quadrilaterals 512 are concave.

Figure 11:
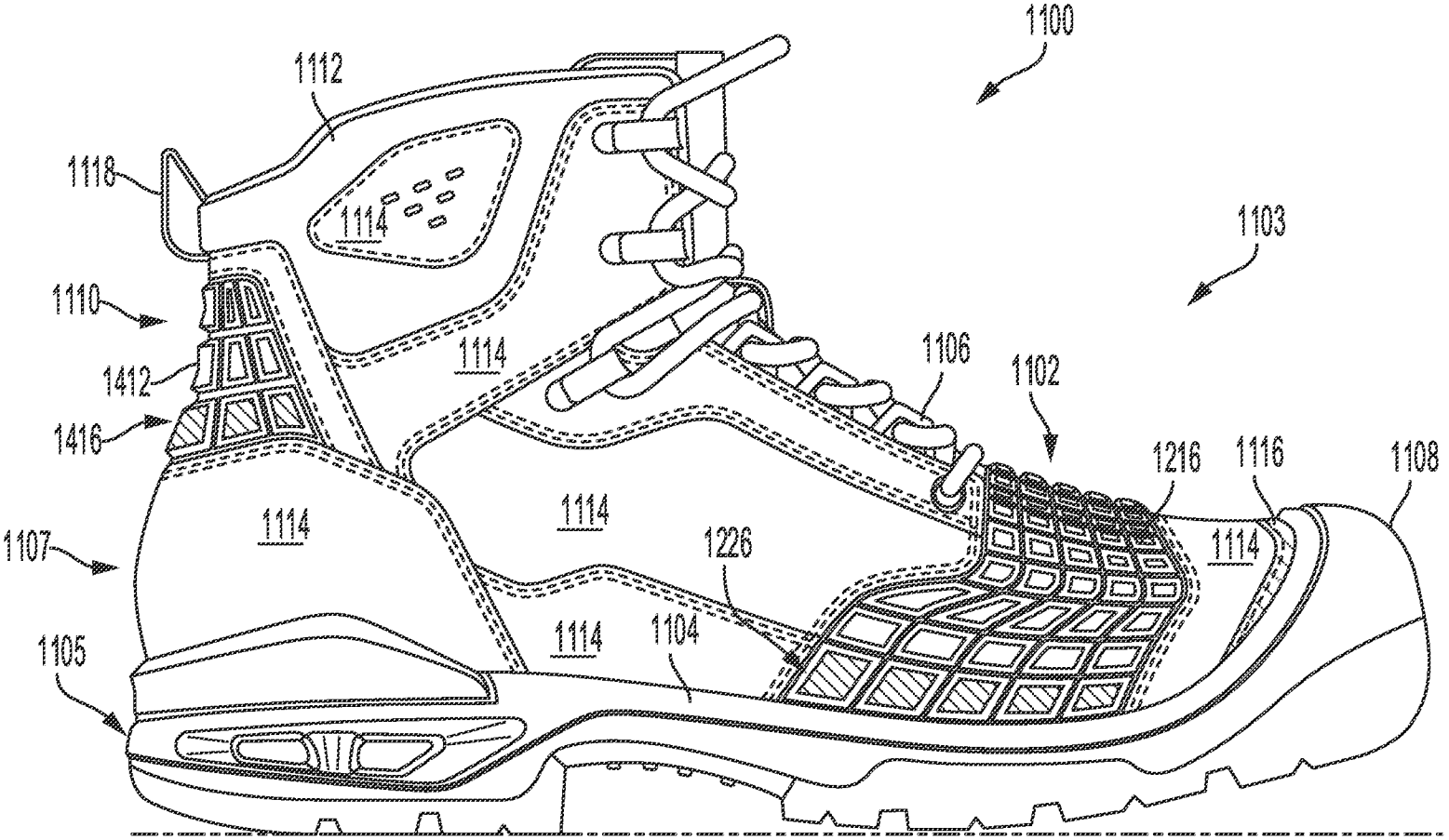
FIG. 11 shows a side view of a fourth example footwear article, in accordance with one or more embodiments of the present disclosure.

A fourth example of a footwear article 1100, also adapted with grid bellows features, is shown in FIG. 11. The footwear article 1100 has a wear guard configuration coupled to one or more regions of an upper 1103 of the footwear article 1100, including a vamp wear guard 1102 at a vamp, e.g., along a metatarsal phalangeal joint region of the footwear article 1100. The vamp wear guard 1102 may be an articulated, flexible shield extending across an entire width of the vamp and may meet and abut a bite line 1104, e.g., an upper edge of a sole structure 1105 of the footwear article 1100, at either side of the footwear article 1100. The vamp wear guard 1102 may also extend a portion of a distance between laces 1106 and a toe guard 1108 of the footwear article 1100 along a length of the vamp.

Figure 12:
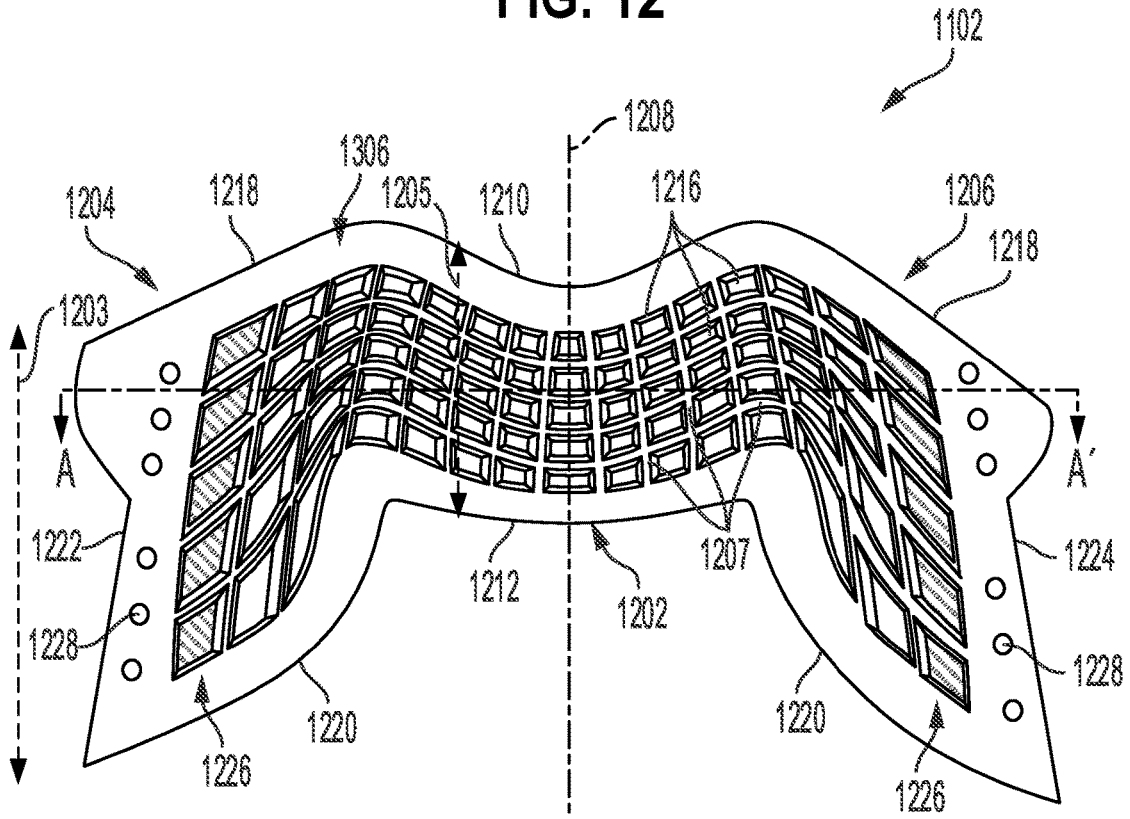
FIG. 12 shows a plan view of the bellows configuration for a vamp of the fourth example footwear article.

The vamp wear guard 1102 is shown in greater detail from a plan view in FIG. 12. However, as described above, the vamp wear guard 1102 may be molded to a shape of the vamp of the upper 1103 of the footwear article 1100 of FIG. 11. The vamp wear guard 1102 includes a central portion or saddle 1202, a first wing 1204 coupled to a first side of the saddle 1202, and a second wing 1206 coupled to a second, opposite side of the saddle 1202, the saddle 1202 and the wings 1204, 1206 forming a single, continuous planar structure with a medial line 1208. An overall geometry of the vamp wear guard 1102 may have an upside-down "W" shape where the first and second wings 1204, 1206 have greater widths (as defined as parallel with the medial line 1208) than the saddle 1202. The shape of the vamp wear guard 1102 may be configured to accommodate contours of the footwear article 1100 and cover a target surface area of the vamp. Furthermore, the saddle 1202 may cover a shorter distance along a length of the footwear article 1100 than either of the first and second wings 1204, 1206.

The saddle 1202 may be symmetric about the medial line 1208 and may have a first edge 1210, configured to be proximate to the toe guard 1108 of the footwear article 1100 of FIG. 11, and a second edge 1212, arranged proximate to the shoe laces 1106 of the footwear article 1100. The first edge 1210 and the second edge 1212 may have different curvatures. For example, as shown in FIG. 12, the first edge 1210 may be more curved than the second edge 1212. The saddle 1202 may include raised sections or articulations that are substantially rectangular in shape, e.g., quadrilaterals 1216, forming a grid pattern or formation across the saddle 1202. The quadrilaterals 1216 may not have uniform dimensions and may vary in width and length (as defined as perpendicular to the medial line 1208) across the saddle 1202. However, the quadrilaterals 1216 of the saddle 1202 may be more uniform in dimensions than the quadrilaterals 1216 of the first wing 1204 and the second wing 1206.

The grid pattern of the quadrilaterals 1216 of the saddle 1202 may follow an overall curvature of the saddle 1202 such that rows of the quadrilaterals 1216 (e.g., quadrilaterals aligned perpendicular to the medial line 1208 and parallel with a width of the footwear article 1100) may be curved while columns of the quadrilaterals 1216 (e.g., quadrilaterals aligned parallel to the medial line 1208 and parallel with a length of the footwear article 1100) may be straight, e.g., linearly aligned.

As shown in FIG. 7, the medial panel 712 of the bellows configuration 700 has one fewer rows of quadrilaterals 512 than the wings 708, 710. However, in the footwear article 1100 of FIG. 11, the saddle 1202 (as shown in FIG. 12) of the vamp wear guard 1102 may have an equal number of rows of quadrilaterals 1216 as the first and second wings 1204, 1206. As such, the quadrilaterals 1216 of the central portion 1202 of the vamp wear guard 1102 may have smaller dimensions than the quadrilaterals 512 of the medial panel 712 of FIG. 7. The smaller size but greater quantity of quadrilaterals 1216 of the saddle 1202 of the vamp wear guard 1102 may provide enhanced flexibility in the metatarsal phalangeal region of the footwear article 1100 of FIG. 11, with respect to the footwear article 500 of FIGS. 5 and 6. In other words, the quadrilaterals 1216 may provide increased articulation along the vamp of the footwear article 1100.

In addition, an overall length 1203 of each of the first and second wings 1204, 1206, may be greater than a length 1205 of the saddle 1202 while each of the wings has fewer quadrilaterals 1216 than the saddle 1202. Thus, the quadrilaterals 1216 of the wings may each cover a greater surface area of the vamp than each quadrilateral 1216 of the saddle 1202. In other words, the quadrilaterals 1216 of the wings are larger (e.g., in width and length) than the quadrilaterals 1216 of the saddle 1202. The grid pattern of the vamp wear guard 1102 provides points of flexion, e.g., pivot points 1207 at regions between each of the rows and each of the columns of the quadrilaterals 1216 and connecting the quadrilaterals 1216 to one another. As described above, the quadrilaterals 1216 of the saddle 1202 may be smaller than the quadrilaterals 512 of the medial panel 712 of FIG. 7. Thus the pivot points 1207 are spaced closer together than in the saddle 1202 of the vamp wear guard 1102 of FIGS. 11-13 than in the medial panel 712 of the bellows configuration 700 of FIG. 7. The closer spacing of the quadrilaterals 1216 of the vamp wear guard 1102 in the saddle 1202 allows the saddle to have greater flexibility, imposing less resistance to flexing of the footwear article 1100 at across a top of the metatarsal phalangeal region.

The pivot points 1207 between quadrilaterals 1216 of the first wing 1204 and the second wing 1206 may be spaced further apart from one another compared to the saddle 1202 due to the larger dimensions of the quadrilaterals 1216. Furthermore, the dimensions of the quadrilaterals 1216 may increase in directions away from the saddle 1201 along each of the first wing 1204 and the second wing 1206. As such, an outer column 1226 of each of the wings may have the largest quadrilaterals 1216. The larger sizes of the quadrilaterals 1216 separating the pivot points 1207 at the wings may decrease a flexibility of the vamp wear guard 1102 at the wings, e.g., along sides of the vamp of the footwear article 1100. By decreasing the flexibility of the vamp wear guard 1102 at along the sides, increased structural support is provided by the vamp along sides of the metatarsal phalangeal region where less flexion of the footwear article is demanded. By varying a flexibility of the vamp wear guard 1102 based on a configuration of the grid pattern, a level of comfort offered by the footwear article 1100 is increased.

The first wing 1204 and the second wing 1206 may have similar shapes, each wing having a same quantity of quadrilaterals 1216. Shapes of the quadrilaterals 1216 may vary to allow the grid formation of the quadrilaterals 1216 to follow a shape of the first and second wings 1204, 1206 which may each have a straight upper edge 1218 and a curved lower edge 1220. The first wing 1204 has a first outer edge 1222 and the second wing has a second outer edge 1224. Each outer edge has both curved and linear portions but the first outer edge 1222 and the second outer edge 1224 may have different profiles. Variations in profile between the first and second outer edges 1222, 1224 may result from the configuring the outer edges to match the bite line 1104 of inner and outer sides of the footwear article 1100 of FIG. 11.

The quadrilaterals 1216 of each of the first and second wings 1204, 1206 may include an outer column 1226, e.g., an outermost column, of quadrilaterals 1216. When coupled to the footwear article 1100 of FIG. 11, each outer column 1226 may be proximate to the bite line 1104 and extend along the bite line 1104 while matching a curvature of the bite line 1104, as shown in FIG. 11. An edge profile of each outer column 1226, may therefore be relatively linear, e.g., the quadrilaterals 1216 of each outer column 1226 are arranged so that outermost edges of the quadrilaterals 1216 are aligned along a direction parallel with the medial line 1208.

The outer column 1226 may be configured to undergo additional treatment during manufacturing. In one example, a color may be applied to the outer column 1226 by a technique such as pad printing. In other examples, markings and/or images may be transferred to the outer column 1226 by pad printing. In yet other examples, other processes may be used to vary a texture, a material, a protrusion, etc., of the outer column 1226 and/or any of the quadrilaterals 1216 of the vamp wear guard 1102.

Figure 13:
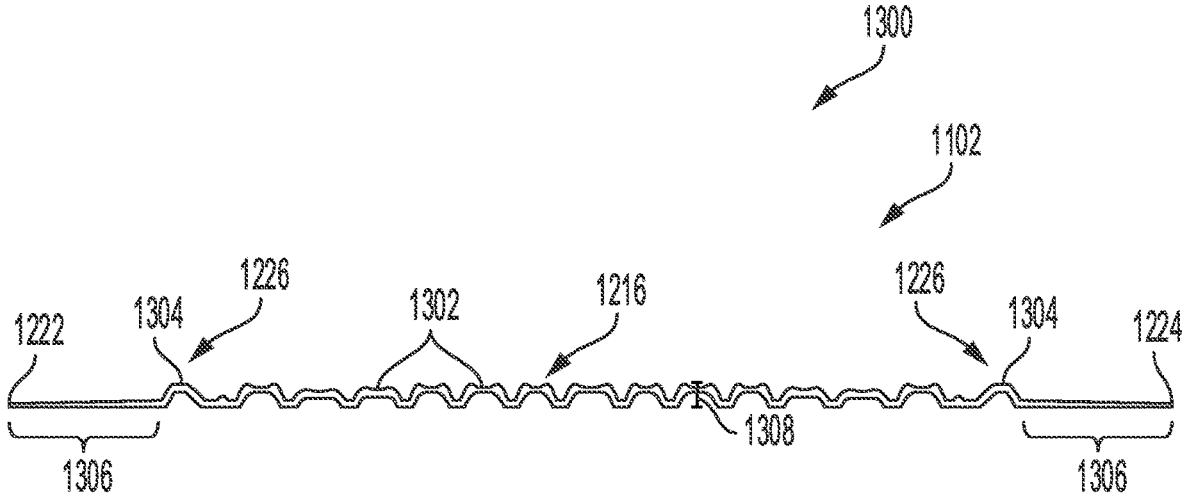
FIG. 13 shows a cross-sectional view of the bellows configuration for the vamp of the fourth example footwear article.

To enable a desired color (or other attribute) to be applied to the outer column 1226, a contour of an upper surface of each of the quadrilaterals 1216 may be modified relative to the quadrilaterals 1216. For example, as shown in FIG. 13 in a cross-section 1300 taken along line A-A' of FIG. 12 upper surfaces 1302 of the quadrilaterals 1216 of the columns in between the outer columns 1226 may be curved and concave. However, the upper surfaces 1304 of the quadrilaterals 1216 of the outer columns 1226 may be straight, e.g., flat and without curvature. The flat upper surfaces 1304 of the quadrilaterals 1216 of the outer columns 1226 may allow a color, an image, a marking, etc., to be applied to the upper surfaces 1304 by a process such as pad printing. In another example, the upper surfaces 1304 may be treated by color daming. The flatness of the upper surfaces 1304 may allow the upper surfaces 1304 to be coated evenly and completely.

A thickness of the vamp wear guard 1102 may be relatively uniform across vamp wear guard 1102 but may be thinner at a central region of the vamp wear guard 1102 and may taper to become thinner at the first outer edge 1222 of the first wing 1204 and at the second edge 1224 of the second wing 1206. The thickness of the vamp wear guard 1102 may, in one example, be between 1.5 to 1.8 mm and taper to 0.8 at the lower edge 1406. The central region of the vamp wear guard 1102 may be 0.6 mm thick, as an example. Furthermore, a protrusion 1308 of the quadrilaterals 1216, e.g., in a direction away from the upper 1103 of the footwear article 1100 and relative to a plane of a border 1306 of the vamp wear guard 1102, may vary between 3.2 to 4.5 mm. It will be appreciated that the exemplary dimensions provided are non-limiting examples, and other dimensions have been contemplated.

The border 1306 may form a continuous frame around the quadrilaterals 1216 of the vamp wear guard 1102. A plurality of openings 1228 may be arranged in columns parallel with each outer column 1226 of the quadrilaterals 1216. Fasteners may be inserted through the plurality of openings 1228 of the border 1306 to attach the vamp wear guard 1102 to the upper 1103 of the footwear article 1100 of FIG. 11.

Figure 14:
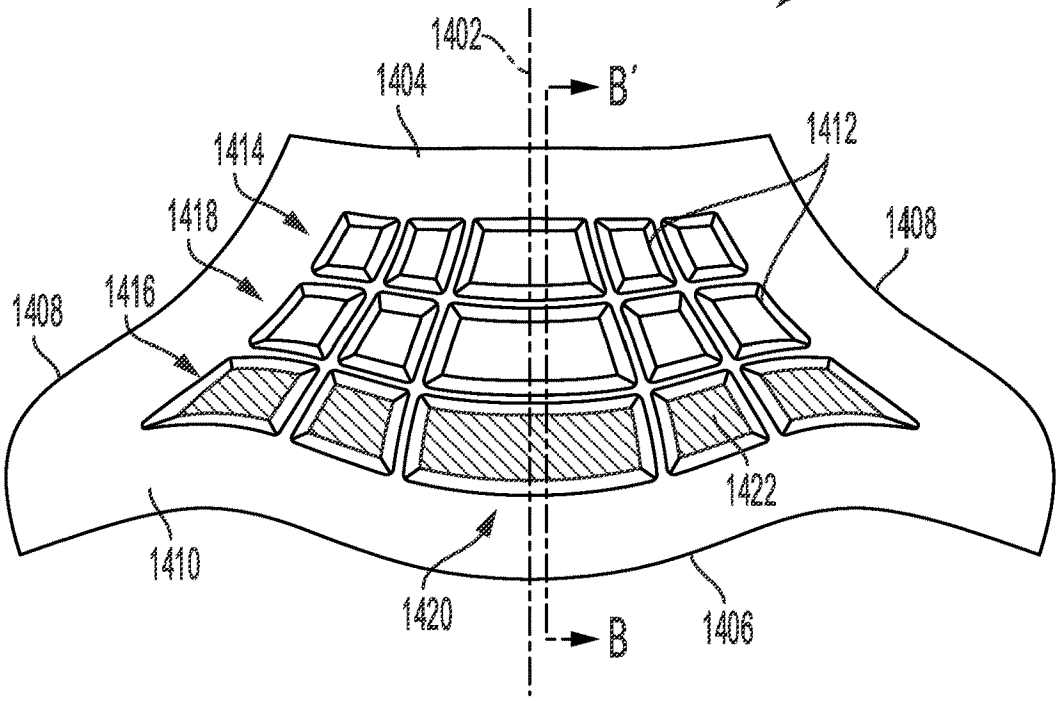
FIG. 14 shows a plan view of the bellows configuration for a heel of the fourth example footwear article.

Returning to FIG. 11, the footwear article 1100 also has a heel guard 1110 arranged at a region of the footwear article 1100 proximate to an Achilles tendon of a wearer and above a heel region 1107 of the upper 1103. The heel guard 1110 also includes bellows features configured as a grid. A plan view of the heel guard 1110 is depicted in FIG. 14, showing a substantially trapezoidal outer geometry of the heel guard 1110. The heel guard 1110 may be symmetric about a medial line 1402 and may have a single continuous, flexible, and articulated structure.

An upper edge 1404 of the heel guard 1110 may be relatively straight while a lower edge 1406 and side edges 1408 of the heel guard 1110 may be curved and sinusoidal. A border 1410 of the heel guard 1110 may continuously surround quadrilaterals 1412 of the heel guard 1110. As shown in FIG. 11, the border 1410 may be positioned under surrounding materials of the upper of the footwear article 1100 and stitched to the upper 1103 to maintain a placement of the heel guard 1110, in one example.

The quadrilaterals 1412 of the heel guard 1110 may be arranged in three rows, e.g., perpendicular to the medial line 1402, and five columns, e.g., parallel with the medial line 1402. A first, top row 1414 of the quadrilaterals 1412 may be aligned relatively linearly while a third, bottom row 1416 of the quadrilaterals 1412 may be aligned to match a curvature of the lower edge 1406 of the heel guard 1110. An alignment of a second, middle row 1418 of the quadrilaterals 1412 may be more linear than the third row 1416 but more curved than the first row 1414.

Figure 6:
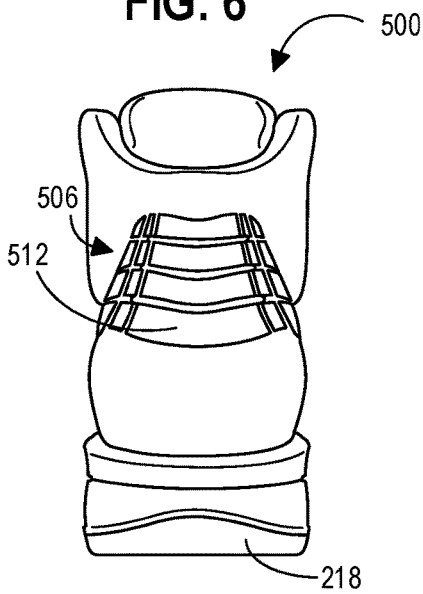
FIG. 6 shows a rear view of the third example footwear article.

The heel guard 1110 of the footwear article 1100 of FIG. 11 is shown with one fewer rows of quadrilaterals 1412 than the heel guard 506 of the footwear article 500 of FIGS. 5 and 6. The reduced number of rows of the heel guard 1110 of FIGS. 11 and 14-15 may allow flexibility of a collar 1112 of the footwear article 1100 to be flexible while providing sufficient support to maintain a shape of the collar 1112.

A geometry of the quadrilaterals 1412 may vary across the heel guard 1110. For example, a central column 1420 of the heel guard 1110 may include quadrilaterals 1412 that are elongated in width (e.g., in a direction perpendicular to the medial line 1402) and larger in area than quadrilaterals 1412 in the other columns. Quadrilaterals 1412 at bottom corners of the heel guard 1110 may have a trailing, curved lower, outer corner. Furthermore, as described above with respect to the vamp wear guard 1102, upper surfaces 1422 of the third row 1416 of the quadrilaterals 1412 may be modified to apply an aesthetic property to the upper surfaces 1422.

Figure 15:
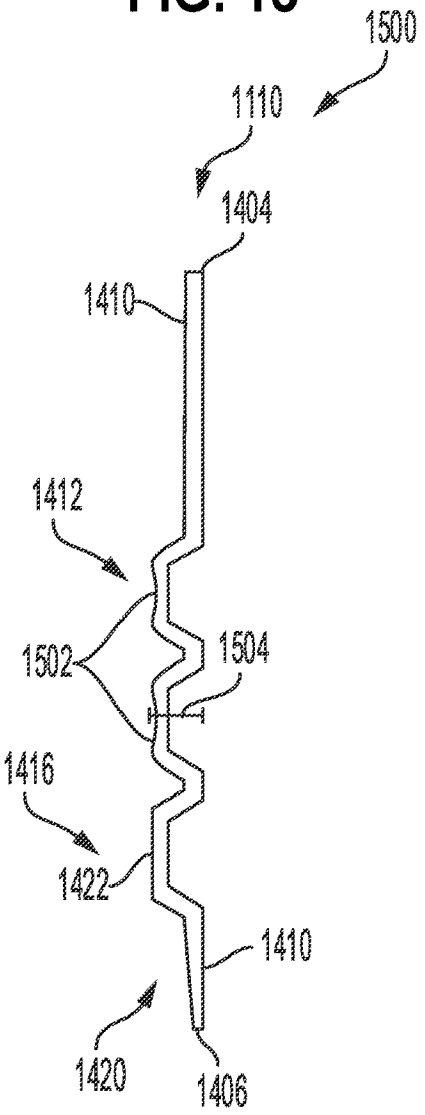
FIG. 15 shows a cross-sectional view of the bellows configuration for the heel of the fourth example footwear article.

For example, as shown in FIG. 15 in a cross-section 1500 taken along line B-B' of FIG. 14, upper surfaces 1502 of the quadrilaterals 1412 of the first and second rows 1414, 1418 may be curved and concave. However, the upper surfaces 1422 of the quadrilaterals 1412 of the third row 1416 may be straight, e.g., flat and without curvature. The flat upper surfaces 1422 of the quadrilaterals 1412 of the third row 1416 may allow a color, an image, a marking, etc., to be applied to the upper surface 1422 by a process such as pad printing. The flatness of the upper surfaces 1422, as described above, may allow the upper surfaces 1422 to be coated evenly.

A thickness of the heel guard 1110 may be relatively uniform across the heel guard 1110 but may taper to become narrower at the edges of the heel guard 1110. The thickness of the heel guard 1110 may, in one example, be between 1.5 to 1.8 mm and taper to 0.8 at the lower edge 1406 while remaining 1.5 mm thick at the upper edge 1404. Furthermore, as an example, the quadrilaterals 1412 may have a protrusion 1504 away from the upper 1103 of the footwear article 1100 and relative to a plane of the border 1410, of 4.5 mm. However, other dimensions have been contemplated.

Returning to FIG. 11, the vamp wear guard 1102 and the heel guard 1110 may be formed of a similar flexible and durable material. For example, the vamp wear guard 1102 and the heel guard 1110 may be formed from TPU. Other regions of the upper of the footwear article 1100 may be formed of similar or different materials, as described above. For example, the collar 1112 of the footwear article 1100 arranged above the heel region 1107 of the footwear article 1100 may be formed from a mesh for breathability and flexibility, a plurality of panels 1114 of footwear article 1100 may be formed from leather, suede, nylon, or some other type of material suitable for footwear. The plurality of panels 1114 may all be formed of a same material or may vary and include a combination of materials.

The footwear article 1100 may additionally include an inlay strip 1116 abutting and extending along an inner perimeter of the toe guard 1108. The inlay strip 1116 may be formed of a similar or different material from the plurality of panels 1114 of the upper 1103 of the footwear article 1100. In one example, the inlay strip 1116 may be modified similarly as the outer column 1226 of the quadrilaterals 1216 of the vamp wear guard 1102 and the third row 1416 of the quadrilaterals 1412 of the heel guard 1110. For example, the inlay strip 1116 may be a different color from the plurality of panels 1114 of the footwear article 1100 or may have markings or an image applied. The footwear article 1100 may further include a loop 1118 attached to the collar 1112 above the heel guard 1110. The loop 1118 may be formed from webbing and may be configured to allow the wearer to insert one or more fingers through the loop 1118 for leverage when donning the footwear article 1100.

FIGS. 16 and 17 illustrate a rear view and a side view of a fifth example of a footwear article 1600 that includes a tab 1604. The footwear article 1600 may generally include an upper 1606 fixedly attached to a sole 1608. The upper 1606 may include a flexible collar portion 1610 and a tongue 1612 configured to partially engage an ankle of a wearer of the footwear article 1600. The flexible collar portion 1610 and the tongue 1612 may define an ankle opening 1614 into which the wearer may insert a foot when putting the footwear article 1600 on. Similarly, the foot of the wearer may be removed from the footwear article 1600 via the ankle opening 1614.

The flexible collar portion 1610 of the upper 1606 may include an ankle border element 1611, a first ankle panel 1613, and a second ankle panel 1615. The ankle border element 1611 may be a padded element, in at least one example. The first ankle panel 1613 and the second ankle panel 1615 may each include a recessed feature 1617*a*, 1617*b* which extends across a back of the ankle. The recessed features 1617*a*, 1617*b* may be laser-welded or pinched regions of the upper 1606. In some examples, the recessed features 1617*a*, 1617*b* may be regions of the upper 1606 into which additional structure support elements (e.g., plastic or rubber strips) have been horizontally inserted (e.g., parallel to the x-axis) into the upper 1606 and the material of the upper 1606 recessed around the inserted support elements (e.g., via laser welding or other suitable methods).

Further, the first ankle panel 1613 may be positioned in between the ankle border element 1611 and the second ankle panel 1615, such that the first ankle panel 1613 is positioned vertically above the second ankle panel 1615. The first ankle panel 1613 and the second ankle panel 1615 may be molded panels. For example, the first ankle panel 1613 and the second ankle panel 1615 may comprise a molded structure, such as a plastic molded structure. A fabric overlay, which may include padding, is positioned on top of the molded panels of the first ankle panel 1613 and the second ankle panel 1615. It is further noted that the first recessed feature 1617*a* of the first ankle panel 1613 and the second recessed feature 1617*b* of the second ankle panel 1615 may be molded into the ankle panels.

The upper 1606 may further include a heel guard 1622 with a plurality of structural ribs 1616, e.g., bellows features, that extend across a heel of the footwear article 1600. The heel guard 1622 may be a molded material attached to a heel region of the upper 1606. The heel guard 1622 may include a top edge 1621 located below the flexible collar portion 1610 of the upper 1606. The top edge 1621 of the heel guard 1622 may be fixedly attached to the material of the upper 1606 via stitching 1624, in one example. A bottom edge (e.g., opposite the top edge 1621) of the heel guard 1622 may be encapsulated by a midsole of the footwear article 1600. In some examples, the heel guard 1622 may be otherwise suitably attached to the material forming the heel region of the upper 1606. The heel guard 1622 may be specifically shaped and positioned to shield a heel region 1623 of the upper 1606, as well as the heel of the wearer, while also sufficient flexion for movement of the user's foot and ankle. Furthermore, the heel guard 1622 includes a first tab 1604 which extends up from the heel guard 1622 in a direction towards the ankle opening 1614 of the footwear article 1600. The first tab 1604 may be configured to impart additional structural integrity to the heel region of the footwear article 1600.

The first tab 1604 may be substantially trapezoidal where the bottom edge 1620 is elongated relative to an upper edge 1650 and includes two arcuate arms that taper to become more narrow while extending across the top edge 1621 of the heel guard 1622 away from the first tab 1604 and on either side of the first tab 1604, as shown in FIG. 16. The first tab 1604 may be oriented such that a width of the upper edge 1650 of the first tab 1604 is narrower than a width of a bottom edge 1620 of the first tab 1604, where the width is defined to be perpendicular to a medial line 1601. The first tab 1604 may be symmetric about the medial line 1601 and have a top portion 1618 that includes the upper edge 1650. The top portion 1618 of the first tab 1604 may vertically extend from the bottom edge 1620 toward the flexible collar portion 1610 of the upper 1606 and be partially disconnected from the footwear article 1600. The position of the first tab 1604 may be within the heel region 1623 of the footwear article 1600 and does not extend beyond, e.g., above, the recessed features 1617*a*, 1617*b* of the second ankle panel 1615.

In some examples, the first tab 1604 may be integrated into the heel guard 1622. For example, the heel guard 1622 may be molded to include the first tab 1604. The heel guard 1622 may be at least partially attached to the upper 1606 via stitching 1624 so that the top portion 1618 of the first tab 1604 is partially disconnected from the footwear article 1600. In some examples, the first tab 1604 and the heel guard 1622 may be separate components. For example, the bottom edge 1620 of the first tab 1604 may be fixedly attached to the top edge 1621 of the heel guard 1622 via stitching 1624 so that the top portion 1618 of the first tab 1604 may be partially disconnected from the footwear article 1600. Such partial disconnection of the first tab 1604 may enable the user to pull on the first tab 1604 while inserting the user's foot into the footwear article 1600 and removing the footwear article 1600 from the foot. In other words, the first tab 1604 may be used for leverage by the user when the user is sliding the foot into the footwear article 1600, e.g., to hold the footwear article 1600 still, and when the user is removing the footwear article 1600, e.g., to move the footwear article 1600 away from the foot.

For example, after the foot of the user is partially inserted into the ankle opening 1614, the user may grip the top portion 1618 of the first tab 1604 and pull the first tab 1604 in an upward direction, as indicated by arrow 1626, so that the foot may become fully inserted into the footwear article 1600 (e.g., as the heel region 1623 is forced upward toward the user's heel due to the fixed connection of the first tab 1604 to the heel region 1623 at the bottom edge 1620). Similarly, once the footwear article 1600 is on the foot, the user may grip the top portion 1618 of the first tab 1604 and pull the first tab 1604 in a downward direction, as indicated by arrow 1628, while pulling the foot in the upward direction to remove the foot from the footwear article 1600. In some examples, the user may grip the top portion 1618 and pull the first tab 1604 away from the tongue 1612 (e.g., along the y-axis) so that the heel region 1623 is temporarily flexed outward which may enable the user to more easily slide the heel of the foot into the footwear article 1600. Alternatively, the user may use the first tab 1604 to hold the footwear article 1600 in a stable position (e.g., the user may grip the top portion 1618 without pulling in any direction) while pushing or pulling the foot into or out of, respectively, the footwear article 1600.

Further, the user may use the first tab 1604 in conjunction with the heel guard 1622 to more easily get the footwear article 1600 on and off. For example, to get the footwear article 1600 off of the right foot, the user may apply downward (e.g., toward the ground, in the downward direction, as indicated by arrow 1628) force or pressure on/against the heel guard 1622 using the left foot while simultaneously pulling the first tab 1604 in the downward direction. The plurality of structural ribs 1616 of the heel guard 1622 may provide traction against the left foot or a left foot version of the footwear article 1600. The force against the heel guard 1622 in conjunction with the force applied at the first tab 1604 may allow the user to easily remove the right foot as it angles and flexes out against the second ankle panel 1615. Thus, the position of the first tab 1604 below the second ankle panel 1615 allows the user to flex the foot to a more comfortable angle within the flexible collar portion 1610 of the upper 1606 while in the process of taking the footwear article 1600 off or putting the footwear article 1600 on. Once the foot is at a comfortable angle, the first tab 1604 and/or the heel guard 1622 may be used to hold the footwear article 1600 stable as the foot is pushed/pulled or as leverage points that allow the user to apply force in a desired direction to more easily get the foot in or out of the footwear article 1600 while maintaining the foot at a comfortable angle.

The first tab 1604 may be formed from a flexible, durable material where the top portion 1618 may maintain a flush position against the upper 1606 when the first tab 1604 is not engaged by the user to assist with donning/removing the footwear article 1600. For example, the first tab 1604 may be formed from natural rubber, vulcanized rubber, leather, synthetic leather, and/or other suitable materials within similar properties. In some examples, the first tab 1604 may be formed from multiple materials so that the two arcuate arms that extend across the heel region 1623 may be less flexible than the top portion 1618 and, thus, the first tab 1604 may provide additional structural integrity to the footwear article 1600. For example, the first tab 1604 may be comprised of leather, with the leather comprising the two arcuate arms further enclosed within natural rubber so that the two arcuate arms are less flexible than the top portion 1618. In some examples, the first tab 1604 may be comprised of the same material as the heel guard 1622, the upper 1606, or another component of the footwear article 1600.

In some examples, the top portion 1618 of the first tab 1604 may have enhancements, such as a pattern of grooves, striations, recesses, and/or protrusions to enhance the grip of the user, e.g., to provide traction for the grip of the user. For example, the top portion 1618 may have a series of horizontal grooves. When the user grips the first tab 1604 between a thumb and index finger, the horizontal grooves may circumvent slipping of the user's hand off the first tab 1604 when the user pulls the first tab 1604 in the upward or downward direction, as indicated by arrow 1626, 1628. In some examples, the top portion 1618 may be partially cushioned, where the cushion may further enhance the user's grip on the first tab 1604 and increase the user's comfort when using the tab 1604 to assist in removing the footwear article 1600 or putting the footwear article onto the foot. In some examples, the top portion 1618 of the first tab 1604 may include an opening that may allow the user to partially insert the tip of a finger or a tool into the opening to reinforce the user's grip on the first tab 1604.

Further, the footwear article 1600 may include a second tab 1630, where the first tab 1604 and the second tab 1630 may be simultaneously employed by the user to assist in sliding the footwear article 1600 on or off the foot. In some examples, the second tab 1630 may be rectangular and include a first edge 1632 that is fixedly attached to the one of the arcuate arms of the first tab 1604 so that the rest of the second tab 1630 is disconnected from the footwear article 1600. Thus, the first tab 1604 and the second tab 1630 may both be advantageously gripped by the user to aid in removal of the footwear article 1600 and/or assist with getting the foot into the footwear article 1600. Further, the first tab 1604 and the second tab 1630 may be used in conjunction with the heel guard 1622 to assist in donning/removing the footwear article 1600.

In some examples, the first edge 1632 of the second tab 1630 may be fixedly coupled to the heel guard 1622 immediately below one of the arcuate arms of the first tab 1604. In some examples, the tab 1604 and the second tab 1630 may both be fixedly attached to the heel guard 1622 via stitching 1624. In some examples, the second tab 1630 may not be located at the rear/heel region 1623 of the footwear article 1600. For example, the second tab 1630 may be located on a side of the flexible collar portion 1610. Thus, the user may simultaneously pull on the first tab 1604 and the second tab 1630 such that the rear and the side of the footwear article 1600 are both forced upward or downward to aid insertion of the user's foot into the footwear article 1600 or removal of the footwear article 1600, respectively. In some examples, the footwear article 1600 may include the first tab 1604 in the heel region 1623, the second tab 1630 on a first side of the upper 1606, and a third tab on a second, opposite side of the upper 1606. Thus, the user may utilize different gripping options around the footwear article 1600 that may be advantageously used to assist in wearing/removing the footwear article 1600.

In some examples, the second tab 1630 may be formed from the same material as the first tab 1604 (e.g., the first tab 1604 and the second tab 1630 may both be made of leather). In some examples, the first tab 1604 and the second tab 1630 may be formed from different materials. For example, the first tab 1604 may be vulcanized rubber and the second tab 1630 may be nylon. In some examples, the first tab 1604 and/or the second tab 1630 may be attached to the heel guard 1622 via a variety of methods. For example, the first tab 1604 may be cemented, welted, Goodyear welted, or riveted to the heel guard 1622. In some examples, the first tab 1604 may be fixedly attached to the heel region 1623 and not to the heel guard 1622.

In some examples, the first tab 1604 may have a different shape than shown in FIG. 16. For example, the two arcuate arms of the first tab 1604 may be serpentine rather than arcuate. For example, the top portion 1618 of the first tab 1604 may be circular, ellipsoid, triangular or snowman-shaped rather than substantially trapezoidal. In some examples, the first tab 1604 may have more than one gripping point. For example, the top portion 1618 of the first tab 1604 may be divided into subsections where the user may grip one or multiple subsections. For example, the first tab 1604 may include three disconnected square shaped subsections, with a first square shaped subsection located at the left side of the heel region 1623, a second square shaped subsection located in the middle of the heel region 1623, and a third square shaped subsection located at the right side of the heel region 1623. Thus, the user may grip the subsection that is most advantageous in manipulating the footwear article 1600 on or off of the foot.

In some examples, the first tab 1604 may have a uniform thickness. In some examples, the thickness of the first tab 1604 may be the same as the thickness of the heel guard 1622 (e.g., the heel guard 1622 and the first tab 1604 may both be three mm thick, as one example). In other examples, the first tab 1604 and the heel guard 1622 may have different thicknesses (e.g., the heel guard 1622 may be five mm thick and the first tab 1604 may be three mm thick, for example). In some examples, the thickness of the first tab 1604 may vary. For example, a middle section of the top portion 1618 of the first tab 1604 may be thicker or thinner than sections of the first tab 1604 contiguously adjacent to the middle section. In one example, the middle section may be three mm thick whereas the rest of the first tab 1604 may be five mm thick which may aid the user in determining a suitable grip point on the top portion 1618. Furthermore, the footwear article 1600 may include a flexible vamp wear guard 1702 as shown in FIG. 17.

The vamp wear guard 1702 may be an overlay formed with bellows that include ribs and grooves which provide both force dispersion to reduce degradation of the footwear article 1600 while also allowing flexion at the vamp of the footwear article 1600. The vamp wear guard 1702 includes a bellows formation of ribs 1704 and grooves 1706. The vamp wear guard 1702 may be integrated into the upper 1606 and spaced away from the sole 1608 of the footwear article 1600. The vamp wear guard 1702 may also be spaced away from a toe cap 1708 and the tongue 1612 of the upper 1606. The vamp wear guard 1702 may further increase the ease of sliding the footwear article 1600 on or off as the bellows may provide the foot with extra space to flex into while the heel region 1623 is transitioned on/off the foot using the first tab 1604 and/or heel guard 1622.

It will be appreciated that the implementation of one or more tabs, e.g., the first tab 1604 and the second tab 1630 of FIGS. 16 and 17 in conjunction with the vamp wear guard 1702 and heel guard 1622 shown therein is a non-limiting example of a wear guard configuration and tab combination. The one or more tabs may be used in any of the footwear articles shown in FIGS. 1-6 and 11, as well as any other embodiments of the wear guard configuration. Furthermore, the one or more tabs may be included in footwear articles that do not incorporate the wear guard configuration.

Thus, provided herein is a footwear article including a wear guard configuration that reduces degradation of the upper while still enabling flexibility of the shoe. In particular, the wear guard configuration may comprise a flexible vamp wear guard and/or a heel guard. The vamp wear guard and the heel guard may be adapted with bellows features which may include articulated, raised sections forming a grid. Furthermore, the footwear article may also be adapted with one or more tabs to assist in wearing and removing the footwear article. In this way, the technical effect of reduced degradation of the footwear article while maintaining user comfort and mobility may be achieved.

It will be appreciated that the configurations and/or approaches described herein are exemplary in nature, and that these specific embodiments or examples are not to be considered in a limiting sense, because numerous variations are possible. The subject matter of the present disclosure includes all novel and nonobvious combinations and sub-combinations of the various features, functions, acts, and/or properties disclosed herein, as well as any and all equivalents thereof.

The disclosure also provides support for a footwear article, comprising: an upper, and a wear guard configuration including a vamp wear guard and a heel guard, each of the vamp wear guard and the heel guard adapted with raised articulations arranged in a grid pattern. In a first example of the system, the vamp wear guard extends across a metatarsal phalangeal joint region of the footwear article and abuts a bite line of a sole structure of the footwear article at sides of the footwear article and wherein the heel guard is positioned between a heel region and a collar of the upper at a rear side of the footwear article. In a second example of the system, optionally including the first example, the raised articulations have a quadrilateral geometry and are arranged in rows arranged parallel with a width of the footwear article and columns arranged parallel with a length of the footwear article. In a third example of the system, optionally including the first and second examples, the vamp wear guard includes a central portion and a first wing extending from a first side of the central portion and a second wing extending from a second, opposite side of the central portion and wherein the first wing and the second wing have different shapes. In a fourth example of the system, optionally including the first through third examples, the rows of the raised articulations of the vamp wear guard are curved and the columns of the raised articulations are linear and wherein the central portion, the first wing, and the second wing have an equal number of the rows of the raised articulations. In a fifth example of the system, optionally including the first through fourth examples, the raised articulations of an outermost column of each of the first wing and the second wing, the outermost column of each wing extending along a bite line of a sole structure of the footwear article at either side of the footwear article, have flat upper surfaces. In a sixth example of the system, optionally including the first through fifth examples, the flat upper surfaces of the outermost column of the raised articulations of each of the first wing and the second wing of the vamp wear guard are configured to be treated by pad printing. In a seventh example of the system, optionally including the first through sixth examples, the raised articulations of the central portion of the vamp wear guard have relatively uniform dimensions and wherein the raised articulations of the first and second wings of the vamp wear guard vary more in shape and size than the raised articulations of the central portion. In an eighth example of the system, optionally including the first through seventh examples, the heel guard has a substantially trapezoidal geometry with a linear upper edge, a sinusoidal lower edge, and sinusoidal side edges. In a ninth example of the system, optionally including the first through eighth examples, the rows of the raised articulations of the heel guard become more curved in a direction from the upper edge to the lower edge and wherein the columns of the raised articulations of the heel guard are linearly aligned. In a tenth example of the system, optionally including the first through ninth examples, the raised articulations of a bottom row of the heel guard, the bottom row proximate to the lower edge, have flat upper surfaces. In an eleventh example of the system, optionally including the first through tenth examples, the flat upper surfaces of the raised articulations of the bottom row of the heel guard are configured to be treated by pad printing. In a twelfth example of the system, optionally including the first through eleventh examples, the raised articulations of a central column of the heel guard has larger dimensions than the columns of the raised articulations on either side of the central column.

The disclosure also provides support for a footwear article, comprising: an upper having a flexible collar portion located above a heel region of the upper, and a first tab with a substantially trapezoidal geometry, the first tab coupled to the upper between the flexible collar portion and the heel region and fixedly attached to the upper along a bottom edge of the first tab. In a first example of the system, a width of the first tab is narrower at a top edge than at the bottom edge of the first tab and the bottom edge of the first tab includes arcuate arms extending away from the first tab at either side of the first tab. In a second example of the system, optionally including the first example, an upper portion of the first tab, the upper portion including the top edge, is not attached to the upper and wherein a partial attachment of the first tab to the upper is configured to provide leverage when the upper portion of the first tab is gripped by a user to don and/or remove the footwear article from the user's foot. In a third example of the system, optionally including the first and second examples, the first tab has enhancements including one or more of grooves, striations, recesses, protrusions, and cushioning, the enhancements configured to provide traction when gripped by a user. In a fourth example of the system, optionally including the first through third examples, the system further comprises: a second tab with a rectangular geometry and wherein the second tab is coupled to one of the arcuate arms of the first tab, along a bottom edge of the second tab.

The disclosure also provides support for a footwear article, comprising: an upper, a wear guard configuration coupled to one or more regions of the upper, and a tab fixedly attached to the upper along a first edge of the tab, wherein a second, opposite edge of the tab is detached from the upper. In a first example of the system, the wear guard configuration includes one or more of a heel guard, a vamp wear guard, and a toe cap, and wherein the tab is fixedly coupled to the heel guard.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A footwear article, comprising:

an upper; and a wear guard arranged across a vamp of the upper, the wear guard extending entirely across a width of the vamp to abut a perimeter of a sole structure of the footwear article, wherein the wear guard is configured with a grid pattern of raised articulations, and wherein the wear guard has an upside-down W-shaped geometry.

2. The footwear article of claim 1, wherein the wear guard has a central portion coupled to a first wing along a first side and a second wing along a second, opposite side, and wherein the central portion, the first wing, and the second wing form a single, continuous structure.

3. The footwear article of claim 2, wherein the central portion of the wear guard is positioned on top region of the vamp, above a metatarsal phalangeal region, and wherein the central portion has a shorter overall length than the first wing or the second wing, the length defined along a length of the footwear article.

4. The footwear article of claim 3, wherein the central portion, the first wing, and the second wing have an equal number of rows of the raised articulations and wherein the raised articulations of the central portion have smaller dimensions than the raised articulations of the first and the second wings.

5. The footwear article of claim 4, wherein the raised articulations of the central portion are configured to provide greater flexion than the raised articulations of the first wing and the second wing.

6. The footwear article of claim 4, wherein the dimensions of the raised articulations of the each of the first wing and the second wing increase in directions away from the central portion and wherein the dimensions of the raised articulations of the first wing and the second wing are largest proximate to the perimeter of the sole structure.

7. A footwear article, comprising:

an upper; and a vamp wear guard configuration including a vamp wear guard and a heel guard, each of the vamp wear guard and the heel guard adapted with raised articulations arranged in a grid pattern, wherein the raised articulations of a central column of the heel guard have larger areas than columns of the raised articulations of the heel guard on either side of the central column.

8. The footwear article of claim 7, wherein the vamp wear guard extends across a metatarsal phalangeal joint region of the footwear article and abuts a bite line of a sole structure of the footwear article at sides of the footwear article and wherein the heel guard is positioned between a heel region and a collar of the upper at a rear side of the footwear article.

9. The footwear article of claim 7, wherein the raised articulations of each of the vamp wear guard and the heel guard have a quadrilateral geometry and are arranged in rows arranged parallel with a width of the footwear article and columns arranged parallel with a length of the footwear article.

10. The footwear article of claim 9, wherein the vamp wear guard includes a central portion and a first wing extending from a first side of the central portion and a second wing extending from a second, opposite side of the central portion and wherein the first wing and the second wing have different shapes.

11. The footwear article of claim 10, wherein the rows of the raised articulations of the vamp wear guard are curved and the columns of the raised articulations of the vamp wear guard are linear and wherein the central portion, the first wing, and the second wing have an equal number of the rows of the raised articulations.

12. The footwear article of claim 10, wherein an outermost column of the raised articulations of each of the first wing and the second wing have flat upper surfaces, and wherein the outermost column of the raised articulations of each of the first wing and the second wing extend along a bite line of a sole structure of the footwear article at either side of the footwear article.

13. The footwear article of claim 12, wherein the flat upper surfaces of the outermost column of the raised articulations of each of the first wing and the second wing of the vamp wear guard are configured to be treated by pad printing.

14. The footwear article of claim 9, wherein a bottom row of the raised articulations of the heel guard have flat upper surfaces.

15. The footwear article of claim 14, wherein the flat upper surfaces of the bottom row of the raised articulations of the heel guard are configured to be treated by pad printing.

16. The footwear article of claim 9, wherein the heel guard has a sinusoidal lower edge and sinusoidal side edges, and wherein the heel guard has a trapezoidal outer geometry.

17. A footwear article, comprising:

a wear guard arranged across a metatarsal phalangeal region of the footwear article, the wear guard including a grid pattern of raised articulations with pivot points between the raised articulations, wherein a size of the raised articulations increase in directions away from a central portion of the wear guard and toward a perimeter of a sole structure of the footwear article, and wherein the wear guard has an outer geometry shaped as an upside-down W.

18. The footwear article of claim 17, wherein the wear guard has wings extending from either side of the central portion of the wear guard, the wings positioned along sides of the metatarsal phalangeal region and wherein the wear guard is configured to have greater flexibility at the central portion than the wings.

19. The footwear article of claim 17, further comprising a heel guard arranged above a heel region of the footwear article and wherein the heel guard includes a grid pattern of raised articulations.

20. The footwear article of claim 19, further comprising a tab coupled to the heel guard along a bottom edge of the tab and wherein a top portion of the tab is detached from the footwear article.

* * * * *